US009224380B2

(12) United States Patent
Shiozawa et al.

(10) Patent No.: US 9,224,380 B2
(45) Date of Patent: Dec. 29, 2015

(54) AUDIO DEVICE, AND METHODS FOR DESIGNING AND MAKING THE AUDIO DEVICES

(75) Inventors: Yasuo Shiozawa, Hamamatsu (JP); Hirofumi Onitsuka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 908 days.

(21) Appl. No.: 13/207,975

(22) Filed: Aug. 11, 2011

(65) Prior Publication Data

US 2012/0057736 A1 Mar. 8, 2012

(30) Foreign Application Priority Data

Aug. 17, 2010 (JP) ..... 2010-182270
Aug. 10, 2011 (JP) ..... 2011-174929

(51) Int. Cl.
*G10K 11/172* (2006.01)
*G10D 3/02* (2006.01)

(52) U.S. Cl.
CPC ..... *G10K 11/172* (2013.01); *G10D 3/02* (2013.01); *Y10T 29/49005* (2015.01)

(58) Field of Classification Search
USPC ..... 381/353
See application file for complete search history.

(56) References Cited

U.S. PATENT DOCUMENTS 4,084,367 A 4/1978 Saylor et al.
5,457,291 A * 10/1995 Richardson ..... 181/293
5,621,804 A 4/1997 Beppu
6,009,705 A * 1/2000 Arnott et al. ..... 60/312
7,674,963 B1 3/2010 Poggi
2004/0071546 A1* 4/2004 Werner et al. ..... 415/119
2004/0262077 A1* 12/2004 Huff et al. ..... 181/250
2005/0196004 A1* 9/2005 Baumann ..... 381/328
2007/0070928 A1 3/2007 Sutivong et al.

FOREIGN PATENT DOCUMENTS

CN 101375630 2/2009
DE 26 50 886 A1 5/1977
JP 61-185793 8/1986
JP 2-13105 B2 4/1990
JP 4-159898 A 6/1992
JP 10-110611 4/1998
WO WO 01/45456 A2 6/2001

OTHER PUBLICATIONS

"Acoustoelectronics [Basics and Applications]", May 10, 2005, pp. 75-89 (Thirty (30) pages including English-language translation).
"Sound and Acoustic Wave", Feb. 1, 1978, pp. 114-119 (Nineteen (19) pages including English-language translation).

(Continued)

*Primary Examiner* — Duc Nguyen
*Assistant Examiner* — George Monikang
(74) *Attorney, Agent, or Firm* — Crowell & Moring LLP

(57) ABSTRACT

An audio device is provided with a plurality of Helmholtz resonators. Whereas a cross-sectional area of a neck and a volume of a cavity communicating with the neck are same between at least two of the Helmholtz resonators, a ratio of minimum and maximum values of distances between a center of gravity of the cross section of the neck and individual points defining an outer periphery of the cross section is different between said at least two of the Helmholtz resonators.

13 Claims, 12 Drawing Sheets

(56) References Cited

OTHER PUBLICATIONS

"Helmholtz Resonator", Ditionary Acoustic Terms New Edition, (Five (5) pages including English-language translation).

Beranek, Leo L.: "Acoustics", Dec. 31, 1993, Acoustical Society of America, New York, XP002665183, ISBN: 088318494X, pp. 128-137.

Extended European Search Report dated Dec. 21, 2011 (nine (9) pages).

Chinese Office Action with English translations dated May 5, 2015 (17 pages).

Office Action in Japanese Patent Application No. P2011-174929 dated Apr. 21, 2015.

* cited by examiner

AUDIO DEVICE, AND METHODS FOR DESIGNING AND MAKING THE AUDIO DEVICES

BACKGROUND

The present invention relates to audio devices each provided with one or more Helmholtz resonators and also relates to methods for designing and making the audio devices.

Among the conventionally-known audio devices, including members corresponding to a neck and cavity of a Helmholtz resonator, such as sound absorbing panels are ones which are constructed to vary acoustic effects achieved thereby through adjustment of sizes of the members. Helmholtz resonance in the Helmholtz resonator is a phenomenon where, in response to sound waves of a resonant frequency fr of the Helmholtz resonator entering (or being introduced into) the neck, air within the neck violently vibrates together with air located in the neighborhood of the outer side of the neck so that energy of the introduced sound waves is reduced by being converted to heat on the inner peripheral surface of the neck.

Japanese Patent Application Laid-open Publication No. HEI-4-159898 (hereinafter referred to as "patent literature 1") discloses a speaker system and more particularly a technique of varying a resonant frequency fr by adjusting a length of a member of a sound absorbing panel which corresponds to the neck of the Helmholtz resonator. The sound absorbing panel disclosed in patent literature 1 includes upper and bottom surface plates spaced opposed to each other via four side surface plates, and an accordion-type or bellows-type hose having one end opening in the upper surface plate and extending toward the bottom surface plate. In the disclosed sound absorbing panel, the bellows-type hose functions as the neck of the Helmholtz resonator, and a space interposed between the upper and bottom surfaces functions as the cavity of the Helmholtz resonator.

The Helmholtz resonator can be regarded as a mechanical-type single resonance system where air violently vibrating in response to sound waves of the resonant frequency fr being introduced into the neck is mass m and air within the cavity is a spring of a spring constant k, and relationship as indicated by Mathematical Expression (1) below is established among the resonant frequency fr, mass m and spring constant. k (see "Dictionary of Audio Terms New Edition", Acoustical Society of Japan, Jul. 15, 2004, page 350)).

$$fr=\tfrac{1}{2\pi}(k/m)^{1/2} \quad (1)$$

Also, if the neck of the Helmholtz resonator has a cross-sectional area S, the cavity has a volume V and the neck has a length L, Mathematical Expression (1) above can be converted to Mathematical Expression (2) below, where c represents the speed of sound and ΔL represents an open end correction value to be added to the neck length L in order to fill a difference between the mass m of the air violently vibrating in response to sound waves of the resonant frequency fr being introduced into the neck and mass m' of air within the neck (m'<m).

$$fr=(c/2\pi)\{S/[(L+\Delta L)V]\}^{1/2} \quad (2)$$

In the Helmholtz resonator, as shown in Mathematical Expression (2), the resonant frequency fr becomes higher as the neck length L is reduced, while the resonant frequency fr becomes lower as the neck length L is increased. Thus, with the technique disclosed in patent literature 1, the frequency of a sound to be absorbed becomes higher as the hose is reduced in length (L) and becomes lower as the hose is increased in length (L).

However, the technique disclosed in patent literature 1 would present the problem that designing and making the sound absorbing panels requires time and labor, because the sound absorbing panels are complicated in construction as compared to counterparts where the hose is fixed in length.

SUMMARY OF THE INVENTION

In view of the foregoing, it is an object of the present invention to provide an improved audio device which can generate Helmholtz resonance at desired frequencies without involving increase in a burden for designing and making individual ones of the audio devices.

The present invention has been made on the basis of the results of research by the inventors of the present invention etc. that the resonant frequency varies if a cross-sectional shape of a neck of a Helmholtz resonator differs even where a cross-sectional area and length of the neck and the volume of the cavity of the Helmholtz resonator are the same. Namely, according to the present invention, there can be provided audio devices capable of generating Helmholtz resonance at desired frequencies by only differentiating the cross-sectional shape of the neck between the individual types of audio devices while the same cross-sectional area and length of the neck and the volume of the cavity are set for the all of the individual types of audio devices. Thus, in designing and making audio devices capable of generating Helmholtz resonance of various frequency characteristics, the present invention can minimize a burden for designing and making the audio devices.

According to an aspect of the present invention, there is provided an improved audio device provided with a plurality of Helmholtz resonators, in which whereas a cross-sectional area of a neck and a volume of a cavity communicating with the neck are the same between at least two of the Helmholtz resonators, a ratio of minimum and maximum values of distances between a center of gravity of the cross section of the neck and individual points defining an outer periphery of the cross section is different between said at least two of the Helmholtz resonators. This audio device has been made on the basis of the aforementioned results of research by the inventors of the present invention etc. With the audio device of the present invention, the resonant frequencies of the Helmholtz resonators can be varied through simple operation.

According to another aspect of the present invention, there is provided an improved audio device provided with one or more types of Helmholtz resonators, in which each of the Helmholtz resonators includes a neck and a cavity communicating with the neck, and in which at least one of the Helmholtz resonators further includes a mechanism that varies a cross-sectional shape of the neck without varying a cross-sectional area and length of the neck. This audio device too has been made on the basis of the aforementioned results of research by the inventors of the present invention etc., and it can generate Helmholtz resonance at a plurality of frequencies of wide frequency bands.

According to still another aspect of the present invention, there is provided an improved audio device provided with a Helmholtz resonator, in which the Helmholtz resonator includes a neck and a cavity communicating with the neck, and in which any one of a plurality of types of necks is detachably attachably provided in the Helmholtz resonator, and, whereas a cross-sectional area and length of the neck are the same between the plurality of types, a cross sectional shape of the neck is different between individual ones of the types. This audio device too has been made on the basis of the aforementioned results of research by the inventors of the present invention etc., and it can generate Helmholtz resonance at a plurality of frequencies of wide frequency bands.

According to still another aspect of the present invention, there is provided an improved method for designing a plurality of types of audio devices each provided with a plurality of Helmholtz resonators, which comprises: a step of designing a cavity of each of the Helmholtz resonators individually for each of the types of audio devices, a volume of the cavity being the same between the Helmholtz resonators; and a step of designing a neck, communicating with the cavity, of each of the Helmholtz resonators, in which, whereas a cross-sectional area of the neck are the same between the plurality of types of audio devices, a ratio of minimum and maximum values of distances between a center of gravity of the cross section of the neck and individual points defining an outer periphery of the cross section is differentiated between at least two of the Helmholtz for each of the plurality of types of audio devices, and a difference of said ratio between said at least two of the Helmholtz resonators is differentiated between at least two of the plurality of audio devices.

According to still another aspect of the present invention, there is provided an improved method for making a plurality of types of audio devices each provided with a plurality of Helmholtz resonators, which comprises: a step of forming a cavity of each of the Helmholtz resonators individually for each of the types of audio devices, a volume of the cavity being the same between the Helmholtz resonators; and a step of forming a neck, communicating with the cavity, of each of the Helmholtz resonators, in which, whereas a cross-sectional area of the neck are the same between the plurality of types of audio devices, a ratio of minimum and maximum values of distances between a center of gravity of the cross section of the neck and individual points defining an outer periphery of the cross section is differentiated between at least two of the Helmholtz for each of the plurality of types of audio devices, and a difference of said ratio between said at least two of the Helmholtz resonators is differentiated between at least two of the plurality of audio devices.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

<First Embodiment>

Figure 1:
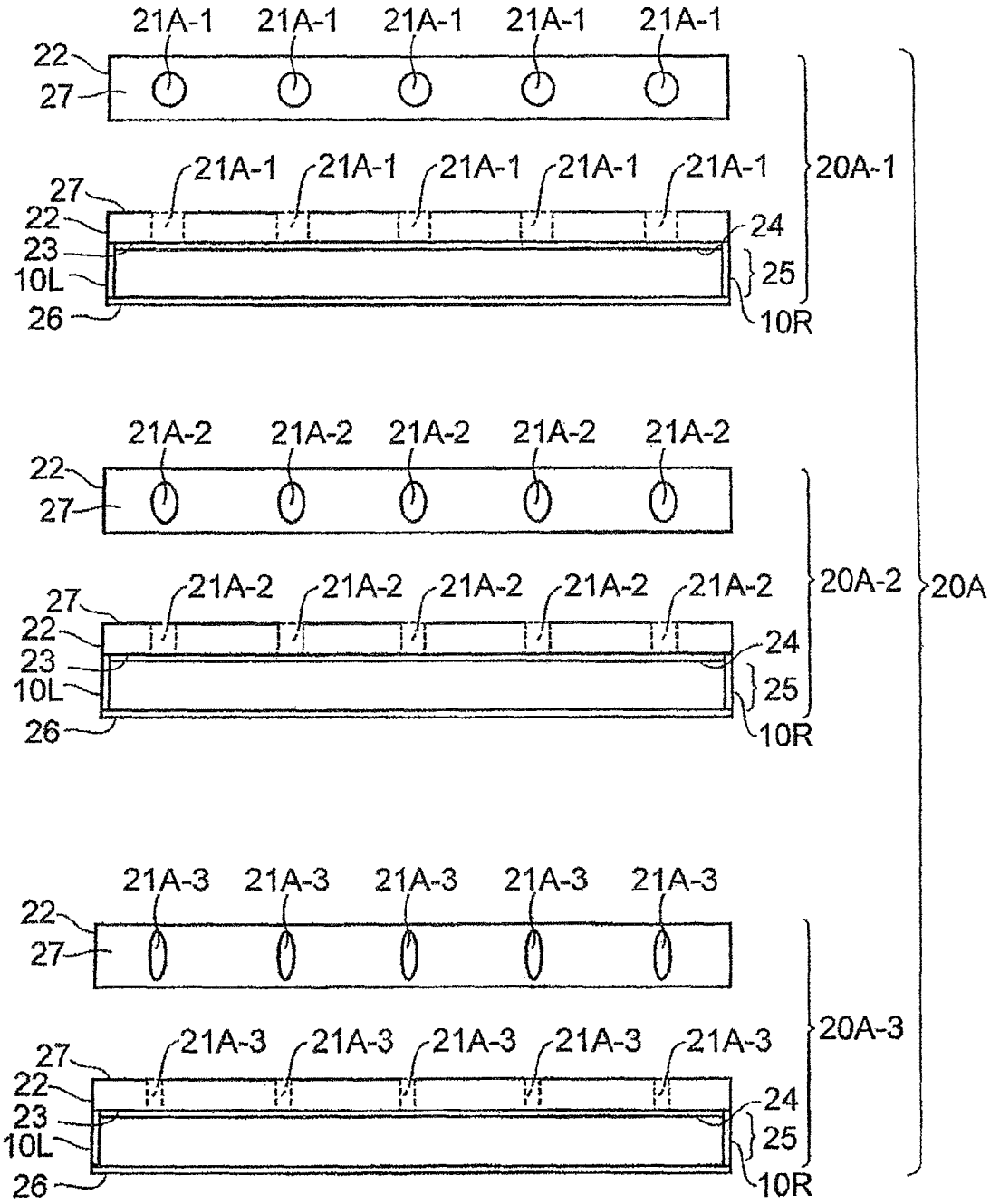
FIG. 1 is a view showing an example construction of a sound absorbing panel group that is a first embodiment of the present invention.
Figure 2:
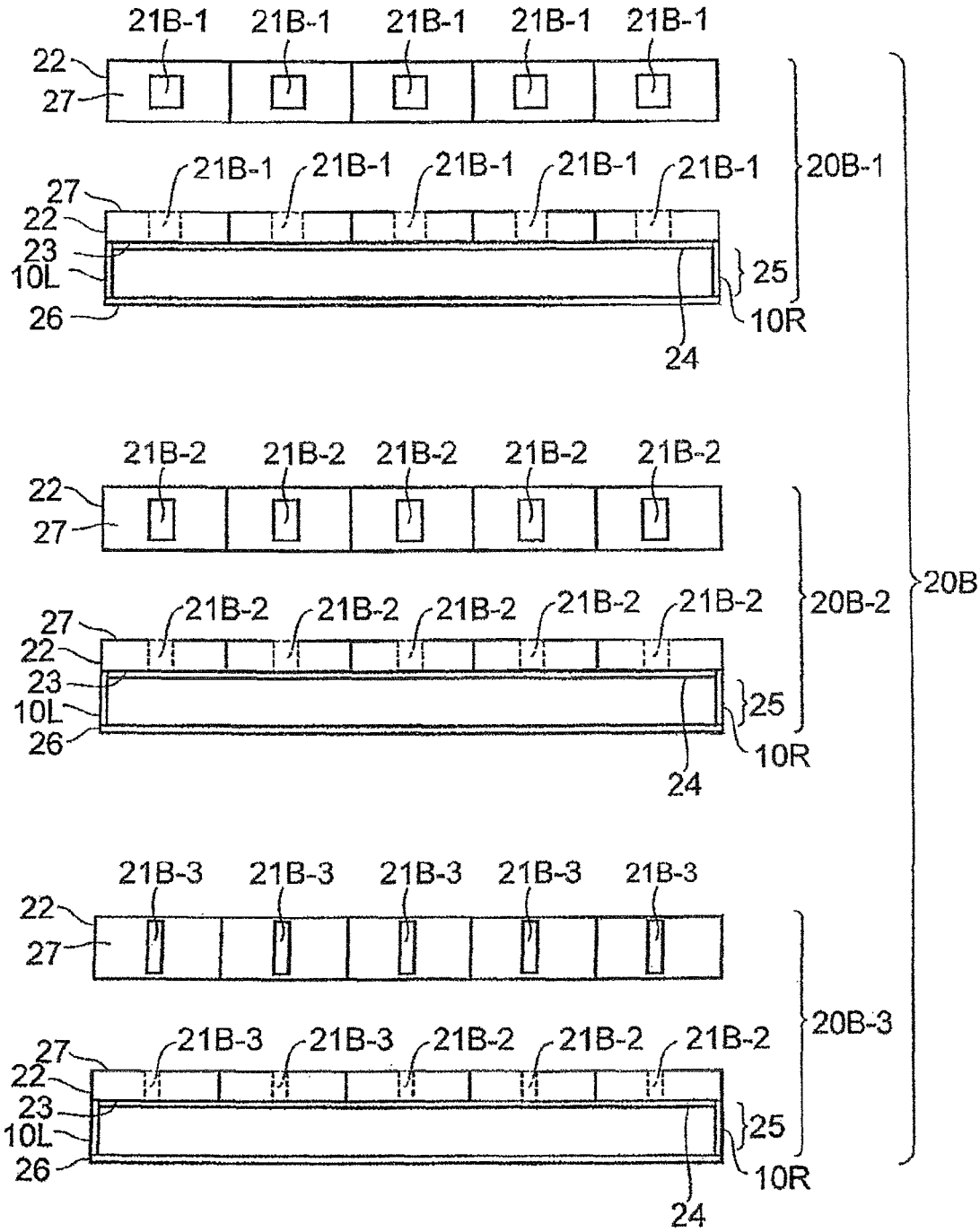
FIG. 2 is a view showing an example construction of a sound absorbing panel group that is a first embodiment of the present invention.

FIGS. 1 and 2 are diagrams showing sound absorbing panel groups 20A and 20B that are audio device groups according to a first embodiment of the present invention. The sound absorbing panel group 20A comprises a plurality of types (e.g., three types) of sound absorbing panels 20A-m (m=1-3), while the sound absorbing panel group 20B comprises a plurality of types (e.g., three types) of sound absorbing panels 20B-n (n=1-3).

As shown in FIG. 1, each of the sound absorbing panels 20A-m includes a thin plate 22 that has a plurality of circular (perfect circular or elliptical) holes 21A-m and that is spaced opposed to a back surface plate 26, via a left side surface plate 10L, right side surface plate 10R, front side surface plate (not shown) and rear side surface plate (not shown), to define an air layer 25 surrounded by the six plates. A porous sound absorbing member 24 is attached to the back surface of the thin plate 22 of each of the sound absorbing panels 20A-m. The porous sound absorbing member 24 serves to attenuate high-frequency components of a sound propagated into the air layer 25 through the holes 21A-m (m=1-3).

As shown in FIG. 2, each of the sound absorbing panels 20B-n includes a thin plate 22 that has a plurality of rectangular (square or elongated rectangular) holes 21B-n and that is spaced opposed to a back surface plate 26, via a left side surface plate 10L, right side surface plate 10R, front side surface plate (not shown) and rear side surface plate (not shown), to define an air layer 25 surrounded by the six plates. A porous sound absorbing member 24 is attached to the back surface of the thin plate 22 of each of the sound absorbing panels 20B-n. The porous sound absorbing member 24 serves to attenuates high-frequency components of a sound propagated into the air layer 25 through the holes 21B-n (n=1-3).

In each of the sound absorbing panels 20A-m, a plurality of Helmholtz resonators are formed by the holes 21A-m of the thin plate 22 and the air layer 25 communicating with the holes 21A-m. Further, in each of the sound absorbing panels 20A-m, each of the holes 21A-m and air layer 25 function as a neck and a cavity, respectively, of one Helmholtz resonator. Namely, each of the holes 21A-m corresponds to the neck, while the air layer 25 corresponds to the cavity. Thus, when a sound of a resonant frequency fr of Helmholtz resonance by the hole 21A-m and air layer 25 enters the hole 21A-m from outside the front surface 27 of the thin plate 22, acoustic energy of the sound is converted to vibrating energy of air within the hole 21A-m and consumed as heat energy etc. In this way, the sound of the resonant frequency fr is absorbed.

In each of the sound absorbing panels 20B-n, a plurality of Helmholtz resonators are formed by the holes 21B-n of the thin plate 22 and the air layer 25 communicating with the holes 21B-n. Further, in each of the sound absorbing panels 20B-n, each of the holes 21B-n and air layer 25 function as a neck and a cavity of one Helmholtz resonator. Namely, each of the holes 21B-n corresponds to the neck, while the air layer 25 corresponds to the cavity. Thus, when a sound of a resonant frequency fr of Helmholtz resonance by the hole 21B-n and air layer 25 enters the hole 21B-n from the front surface 27 of the thin plate 22, acoustic energy of the sound is converted to vibrating energy of air within the hole 21B-n and consumed as heat energy etc. In this way, the sound of the resonant frequency fr is absorbed.

The three types of sound absorbing panels 20A-m (m=1-3) in the group 20A are designed to generate Helmholtz resonance at frequencies $fr_{A1}$, $fr_{A2}$ and $fr_{A3}$, respectively ($fr_{A1}<fr_{A2}<fr_{A3}$). The three types of sound absorbing panels 20B-n (m=1-3) in the group 20B are designed to generate Helmholtz resonance at frequencies $fr_{B1}$, $fr_{B2}$ and $fr_{B3}$, respectively ($fr_{B1}<fr_{B2}<fr_{B3}$).

More specifically, the cross-sectional area S and length L of the hole 21A-m and the volume V of the air layer 25 are the same among the three types of sound absorbing panels 20A-m (m=1-3). Further, relationship, among the three types of sound absorbing panels 20A-m (m=1-3), of a ratio of a minimum value MIN of distances between the center of gravity of the cross section of the hole 21A-m and individual points defining the outer periphery of the cross section to a maximum value MAX of the distances (i.e., ratio MIN/MAX) is the absorbing panel 20A-1>the absorbing panel 20A-2>the absorbing panel 20A-3. More specifically, as shown in FIG. 1, the cross section of each of the holes 21A-1 in the sound absorbing panel 20A-1 has a perfect circular shape, the cross section of each of the holes 21A-2 in the sound absorbing panel 20A-2 has an elliptical shape, and the cross section of each of the holes 21A-3 in the sound absorbing panel 20A-3 has an elliptical shape more flattened than that of the hole 21A-2.

Further, the cross-sectional area S and length L of the hole 21B-n and the volume V of the air layer 25 are the same among the three types of sound absorbing panels 20B-n (n=1-3). Further, relationship, among the three types of sound absorbing panels 20B-n (n=1-3), of a ratio of a minimum value MIN of distances between the center of the cross section of the hole 21B-n and individual points defining the outer periphery of the cross section to a maximum value MAX of the distances (i.e., ratio MIN/MAX) is the absorbing panel 20B-1>the absorbing panel 20B-2>the absorbing panel 20B-3. More specifically, as shown in FIG. 2, the cross section of each of the holes 21B-1 in the sound absorbing panel 20B-1 has a square shape, the cross section of each of the holes 21B-2 in the sound absorbing panel 20B-2 has an elongated rectangular shape, and the cross section of each of the holes 21B-3 in the sound absorbing panel 20B-3 has an elongated rectangular shape more flattened than that of the hole 21B-2.

In the instant embodiment, as set forth above, the cross-sectional area S and length L of the hole 21A-m and the volume V of the air layer 25 are the same among the sound absorbing panels 20A-m (m=1-3) while the cross-sectional area S and length L of the hole 21B-n and the volume V of the air layer 25 are the same among the sound absorbing panels 20B-n (n=1-3), and the sound absorbing panels 20A-m (m=1-3) and sound absorbing panels 20B-n are different only in the shape of the hole 21A-m or 21B-n from one type to another; that is, the shape of the hole 21A-m or 21B-n is different among individual ones of the types. Thus, it is possible to design and make the sound absorbing panels 20A-m (m=1-3) and 20B-n (n=1-3) which generate Helmholtz resonance at different frequencies, without involving increase in a burden for designing and manufacturing individual ones of the sound absorbing panels 20A-m (m=1-3) and 20B-n (n=1-3).

Namely, a method for designing a plurality of types of audio devices (sound absorbing panels 20A-1, 20A-2, 20A-3, or 20B-1, 20B-2, 20B-3) comprises: a step of designing a cavity (25 or 37) of a Helmholtz resonator individually for each of the types of audio devices, a volume of the cavity (25 or 37) being the same among the types of audio devices; and a step of designing a neck (21A or 21B), communicating with the cavity (25 or 37), of each of the Helmholtz resonators, in which, whereas a cross-sectional area and length of the neck (21A or 21B) are the same among the plurality of types of audio devices, a cross-sectional shape of the neck (21A or 21B) is differentiated between individual ones of the types of audio devices, so that a desired characteristic is set for each of the plurality of types of audio devices. Thus, when a human designer designs the plurality of types of audio devices (sound absorbing panels 20A-1, 20A-2, 20A-3, or 20B-1, 20B-2, 20B-3), it is only necessary to differentiate the cross-sectional shape of the neck (21A or 21B) among the individual types of audio devices with the other factors maintained the same for all of the types of audio devices, and thus, the method of the present invention can significantly reduce a load for designing the plurality of types of audio devices.

Further, a method for making a plurality of types of audio devices (sound absorbing panels 20A-1, 20A-2, 20A-3, or 20B-1, 20B-2, 20B-3) comprises: a step of forming a cavity (25 or 37) of a Helmholtz resonator individually for each of the types of audio devices, a volume of the cavity (25 or 37) being the same among the types of audio devices; and a step of forming a neck (21A or 21B), communicating with the cavity (25 or 37), of each of the Helmholtz resonators, in which, whereas a cross-sectional area and length of the neck (21A or 21B) are the same among the plurality of types of audio devices, a cross-sectional shape of the neck (21A or 21B) is differentiated between individual ones of the types of audio devices, so that a desired characteristic is set for each of the plurality of types of audio devices. Thus, when a human designer makes the plurality of types of audio devices (sound absorbing panels 20A-1, 20A-2, 20A-3, or 20B-1, 20B-2, 20B-3), it is only necessary to differentiate the cross-sectional shape of the neck (21A or 21B) among the individual types of audio devices with the other factors maintained the same for all of the types of audio devices, and thus, the method of the present invention can significantly reduce a load for making the plurality of types of audio devices.

A user may select desired ones of the plurality of types of audio devices designed and made in the aforementioned manner and use the selected types of audio devices for an intended purpose.

Figure 3:
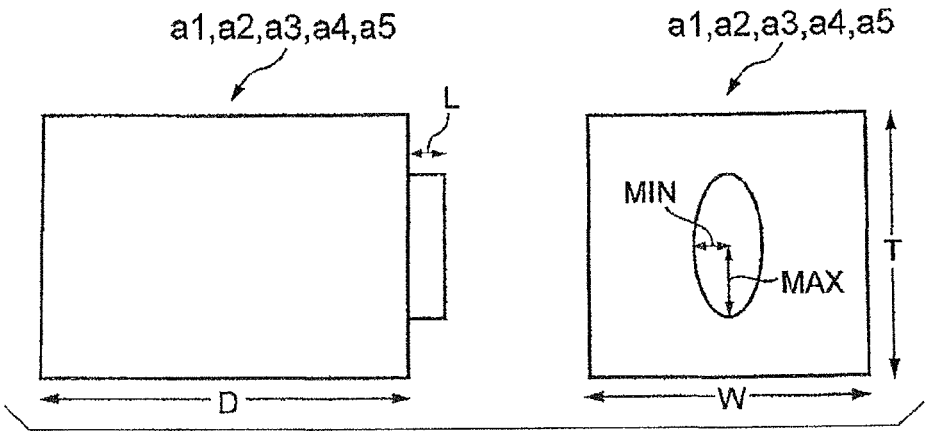
FIG. 3 is a view explanatory of shapes of Helmholtz resonators used in verification of advantageous benefits of the first embodiment.
Figure 4:
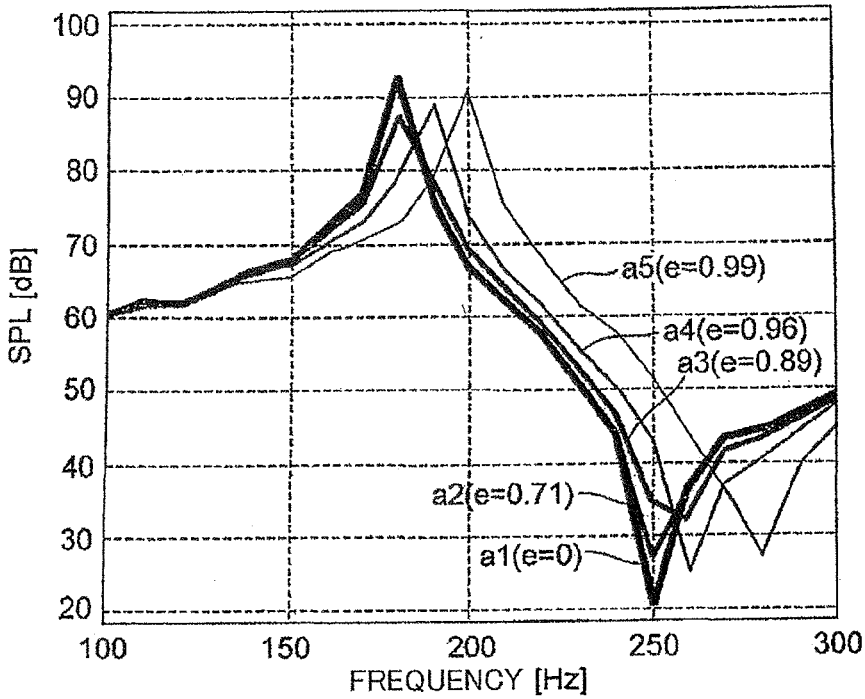
FIG. 4 is a graph showing frequency responses of the Helmholtz resonators shown in FIG. 3.

In order to confirm advantageous benefits of the instant embodiment, the inventors of the present invention etc. conducted the following verifications. In the first verification, for a Helmholtz resonator including a neck of a circular or elliptical cross-sectional shape, eccentricities e ($0 \leq e \leq 1$) were determined by substituting, into Mathematical Expression (3) below, a longitudinal width T, horizontal width W and depth D of the cavity, a cross-sectional area S and length L of the neck and minimum and maximum values MIN and MAX of distances between the center of the neck and individual points defining the outer periphery of the cross section (i.e., MIN and MAX represent short and long axes, respectively, of the ellipse) as shown in Table 1 below, to thereby provide Helmholtz resonators a1, a2, a3, a4 and a5 (see FIG. 3). After that, respective frequency responses of the Helmholtz resonators a1, a2, a3, a4 and a5 were determined. More specifically, a position located one meter in front of the Helmholtz resonators a1, a2, a3, a4 and a5 was set as a sound source position, and the centers of gravity of the necks of the Helmholtz resonators a1, a2, a3, a4 and a5 were set as observation points. Then, for each of the Helmholtz resonators a1, a2, a3, a4 and a5, a frequency response when a sound generated at the sound source was measured at the observation point was calculated by simulation. Curves a1, a2, a3, a4 and a5 shown in FIG. 4 represent the thus-calculated frequency responses of the Helmholtz resonators a1, a2, a3, a4 and a5.

$$e=\{(MAX^2-MIN^2)^{1/2}\}/MAX \quad (3)$$

TABLE 1

| Cavity | | | | Neck | | | | |
|---|---|---|---|---|---|---|---|---|
| Shape | Longitudinal Width T | Horizontal Width W | Depth D | Shape | Cross-sectional Area S | Neck Length L | Eccentricity e | Curve |
| Rectangular Parallelepiped | 100 mm | 100 mm | 200 mm | Perfect Circle | 707 $mm^2$ | 5 mm | 0 | a1 |
| Rectangular Parallelepiped | 100 mm | 100 mm | 200 mm | Ellipse | 707 $mm^2$ | 5 mm | 0.71 | a2 |
| Rectangular Parallelepiped | 100 mm | 100 mm | 200 mm | Ellipse | 707 $mm^2$ | 5 mm | 0.89 | a3 |
| Rectangular Parallelepiped | 100 mm | 100 mm | 200 mm | Ellipse | 707 $mm^2$ | 5 mm | 0.96 | a4 |
| Rectangular Parallelepiped | 100 mm | 100 mm | 200 mm | Ellipse | 707 $mm^2$ | 5 mm | 0.99 | a5 |

Figure 5:
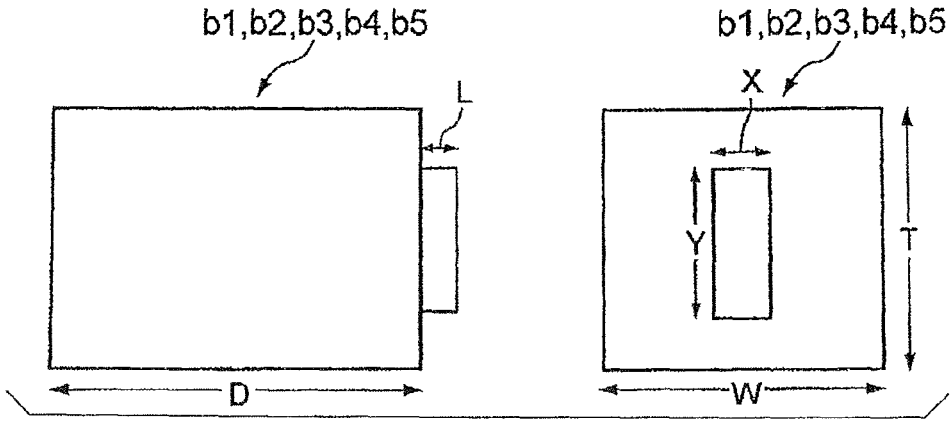
FIG. 5 is a view explanatory of shapes of Helmholtz resonators used in verification of advantageous benefits of the first embodiment.
Figure 6:
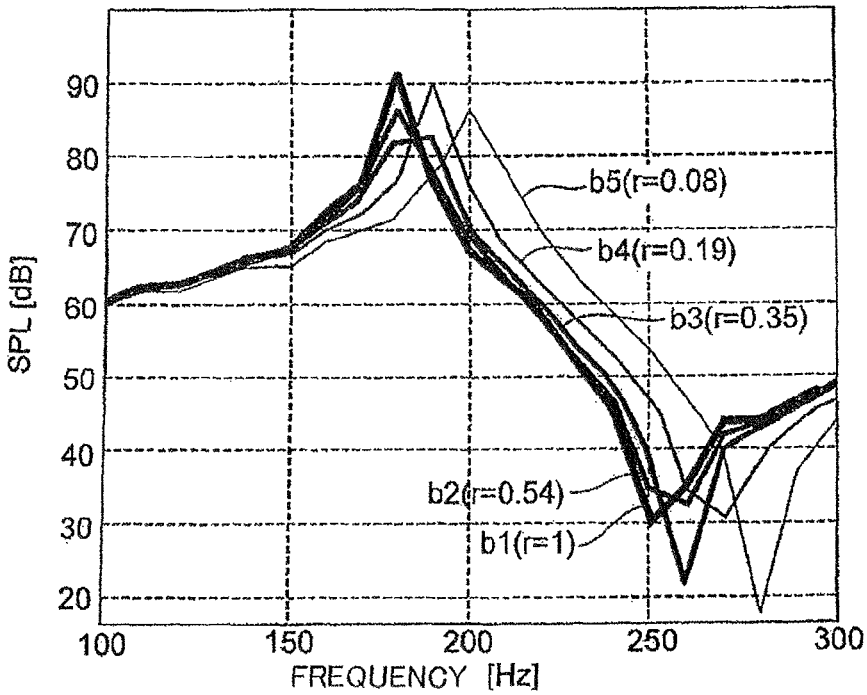
FIG. 6 is a graph showing frequency responses of the Helmholtz resonators shown in FIG. 5.

In the second verification, for a Helmholtz resonator including a neck of a rectangular (square or elongated rectangular), degrees of flattening r ($0 \leq r \leq 1$) were determined by substituting, into Mathematical Expression (4) below, a longitudinal width T, horizontal width W and depth D of the cavity, a cross-sectional area S and length L of the neck and short side length X and long side length Y of the cross section of the neck as shown in Table 2 below, to thereby provide Helmholtz resonators b1, b2, b3, b4 and b5 (see FIG. 5). After that, respective frequency responses of the Helmholtz resonators b1, b2, b3, b4 and b5 were determined. More specifically, a position located one meter in front of the Helmholtz resonators b1, b2, b3, b4 and b5 was set as a sound source position, and the centers of gravity within the necks of the Helmholtz resonators b1, b2, b3, b4 and b5 were set as observation points. Then, for each of the Helmholtz resonators b1, b2, b3, b4 and b5, a frequency response when a sound generated at the sound source was measured at the observation point was calculated by simulation. Curves b1, b2, b3, b4 and b5 shown in FIG. 6 represent the thus-calculated frequency responses of the Helmholtz resonators b1, b2, b3, b4 and b5.

$$r=X/Y \quad (4)$$

TABLE 2

| Cavity | | | | Neck | | | | |
|---|---|---|---|---|---|---|---|---|
| Shape | Longitudinal Width T | Horizontal Width W | Depth D | Shape | Cross-sectional Area S | Neck Length L | Degree of Flattening r | Curve |
| Rectangular Parallelepiped | 100 mm | 100 mm | 200 mm | Square | 707 $mm^2$ | 5 mm | 1 | b1 |

TABLE 2-continued

| Cavity | | | | Neck | | | | |
|---|---|---|---|---|---|---|---|---|
| Shape | Longitudinal Width T | Horizontal Width W | Depth D | Shape | Cross-sectional Area S | Neck Length L | Degree of Flattening r | Curve |
| Rectangular Parallelepiped | 100 mm | 100 mm | 200 mm | Rectangle | 707 $mm^2$ | 5 mm | 0.54 | b2 |
| Rectangular Parallelepiped | 100 mm | 100 mm | 200 mm | Rectangle | 707 $mm^2$ | 5 mm | 0.35 | b3 |
| Rectangular Parallelepiped | 100 mm | 100 mm | 200 mm | Rectangle | 707 $mm^2$ | 5 mm | 0.19 | b4 |
| Rectangular Parallelepiped | 100 mm | 100 mm | 200 mm | Rectangle | 707 $mm^2$ | 5 mm | 0.08 | b5 |

The following can be seen from the foregoing verifications. As shown in FIG. 4, relationship, among the Helmholtz resonators a1, a2, a3, a4 and a5 each including the neck having the perfect circular or elliptical cross section, in the peak frequency of the frequency response is the Helmholtz resonator a1<the Helmholtz resonator a2<the Helmholtz resonator a3<the Helmholtz resonator a4<the Helmholtz resonator a5. Further, relationship, among the Helmholtz resonators a1, a2, a3, a4 and a5, in the eccentricity e is the Helmholtz resonator a1<the Helmholtz resonator a2<the Helmholtz resonator a3<the Helmholtz resonator a4<the Helmholtz resonator a5. Further, as seen in Table 1, the Helmholtz resonators a1, a2, a3, a4 and a5 are different from one another only in the eccentricity e and are identical to one another in the dimensions of the cavity and neck. The smaller the ratio of the minimum value MIN to the maximum value MAX (MIN/MAX), the greater becomes the eccentricity e (i.e., the closer to 1 (one) becomes the eccentricity e). Thus, it can been seen that, in the case of the audio device including the neck having the perfect circular or elliptical cross-sectional shape like the sound absorbing panel 20A-m, the resonant frequency fr becomes higher as the ratio of the minimum value MIN to the maximum value MAX (MIN/MAX) decreases.

Figure 7:
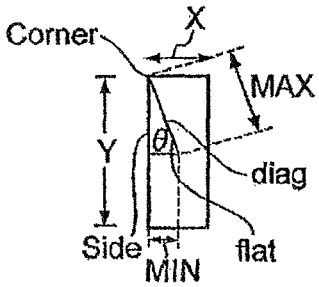
FIG. 7 is a view showing relationship between a long side of a Helmholtz resonator and a maximum value of distances between the center of gravity of a cross section of a hole and individual points defining the outer periphery of the cross section of the Helmholtz resonator.

As shown in FIG. 6, relationship, among the Helmholtz resonators b1, b2, b3, b4 and b5 each including the neck having the rectangular cross-sectional shape, in the peak frequency of the frequency response is the Helmholtz resonator b1<the Helmholtz resonator b2<the Helmholtz resonator b3<the Helmholtz resonator b4<the Helmholtz resonator b5. Further, relationship, among the Helmholtz resonators b1, b2, b3, b4 and b5, in the degree of flattening r is the Helmholtz resonator b1>the Helmholtz resonator b2>the Helmholtz resonator b3>the Helmholtz resonator b4>the Helmholtz resonator b5. Further, as seen in Table 2, the Helmholtz resonators b1, b2, b3, b4 and b5 are different from one another only in the degree of flattening r and are identical to one another in the dimensions of the cavity and neck. As shown in FIG. 7, the short side X of the cross section of the neck is 2·MIN, while the long side Y of the cross section of the neck is 2·MAX·sin θ (θ represents an angle defined by a line flat passing through the center of gravity of the cross section to intersect perpendicularly with one side side and a line diag interconnecting the center of gravity and a corner between the side side and another side adjoining the side side). The smaller the ratio of the minimum value MIN to the maximum value MAX (i.e., ratio MIN/MAX), the smaller becomes the degree of flattening r (i.e., the closer to 0 (zero) becomes the degree of flattening r). Thus, it can been seen that, in the case of the audio device including the neck having the rectangular (square or elongated rectangular) cross-sectional shape like the sound absorbing panel 20B-n of FIG. 2, the resonant frequency fr becomes higher as the ratio of the minimum value MIN to the maximum value MAX (MIN/MAX) decreases.

Figure 8:
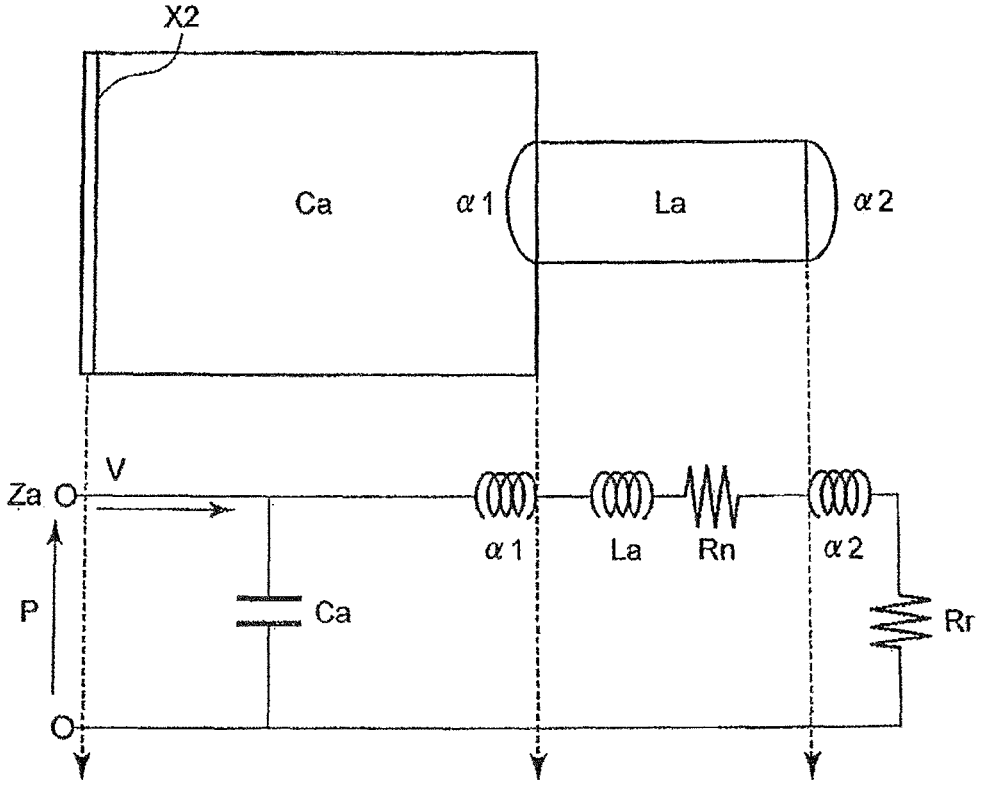
FIG. 8 is a diagram explanatory of a manner in which an additional acoustic mass of the Helmholtz resonator is calculated.

Further, in order to confirm the advantageous benefits of the instant embodiment from another perspective, the inventors of the present invention etc. also conducted the following verifications. In the field of acoustics, it is known to calculate an acoustic impedance Za of a closed space, surrounded by walls, as an impedance of a circuit simulating the closed space; see "Audio Electronics—Basics and Applications", pp 75-89, Toshio Oga, Tomoo Kamakura, Shigemi Saito and Kazuya Takeda, published by Baifukan, May 10, 2004, and "Sound and Soundwaves", pp 114-119, Yutaka Kobashi, published by Shokabo, Jan. 25, 1975. If sound pressure on a bottom surface X2 of the cavity opposite from the neck of the Helmholtz resonator is indicated by P, a particle velocity is indicated by V, a parameter representing softness of air within the cavity (i.e., acoustic compliance parameter) is indicated by Ca, a parameter representing a mass of air within the neck (hereinafter "acoustic mass") is indicated by La, parameters representing masses of air near the opposite ends of the neck resonating together with the acoustic mass (i.e., difference m−m' between the mass m in Mathematical Expression (1) above and the mass m' of the air within the neck, which will hereinafter be referred to as "additional acoustic masses") are indicated by α1 and α2, a parameter representing acoustic resistance within the neck is indicated by Rn and a parameter representing radiation resistance is indicated by Rr, this Helmholtz resonator can be regarded as a circuit having capacity Ca, coil α1, coil La, resistance Rn, coil α2 and resistance Rr connected in parallel to a power supply P, as shown in FIG. 8.

In this circuit, the capacity Ca can be regarded as being in an open state in a region where a vibrating frequency of the bottom surface X2 is sufficiently low. Thus, the acoustic impedance Za of the Helmholtz resonator can be approximated by Mathematical Expression (5) below.

$$Za=Rn+Rr+j2\pi f(\alpha 1+La+\alpha 2) \quad (5)$$

The acoustic impedance Za in Mathematical Expression (5) above is equal to a value calculated by dividing the sound pressure P by a volume velocity Q that is a product between the particle velocity V on the bottom surface X2 and the area S of the bottom surface X2. Thus, Mathematical Expression (5) above can be expressed as $$P/Q=Rn+Rr+j2\pi f(\alpha 1+La+\alpha 2) \quad (6)$$

Looking at only on the imaginary part of Mathematical Expression (6), it can be simplified into Mathematical Expression (7) below.

$$Im(P/Q)=j2\pi f(\alpha 1+La+\alpha 2) \quad (7)$$

The parameter La in Mathematical Expression (7) is a value determined by the volume and air density within the neck. Thus, the additional acoustic mass "$\alpha 1+\alpha 2$" can be determined as follows on the basis of actual measured values of the particle velocity V and sound pressure P on the bottom surface X2. First, the volume velocity Q (complex number with a phase taken into account) is determined by multiplying the actual measured value of the particle velocity V on the bottom surface X2 by the area S of the bottom surface X2, and then, the imaginary part Im(P/Q) of a value calculated by dividing the actual measured value of the sound pressure P (complex number with a phase taken into account) by the volume velocity Q is obtained. After that, "$\alpha 1+La+\alpha 2$" in Mathematical Expression (7) above is determined by dividing the imaginary part Im(P/Q) by $2\pi f$. Then, the value La determined by the volume and air density within the neck is subtracted from "$\alpha 1+La+\alpha 2$", to determine the additional acoustic mass $\alpha 1+\alpha 2$.

In light of the foregoing, the inventors of the present invention provided Helmholtz resonators a1-1, a1-2, . . . , a1-M by varying little by little the shape of the neck of the aforementioned Helmholtz resonator a1 (eccentricity e=0, which means a perfect circular shape) in such a manner that the eccentricity e approaches 1 (one), and then individually measured the sound pressure P and particle velocity V on the bottom surface X2 (of the cavity opposite from the neck) of each of the Helmholtz resonators a1-1, a1-2, . . . , a1-M with the frequency of the sound source sufficiently lowered. Then, a sum between the additional acoustic masses $\alpha 1$ and $\alpha 2$ for each of the Helmholtz resonators a1-1, a1-2, . . . , a1-M is calculated on the basis of the measurements of the sound pressure P and particle velocity V and Mathematical Expression (7) above. Similarly, the inventors of the present invention provided Helmholtz resonators b1-1, b1-2, . . . , b1-N by varying little by little the shape of the neck of the aforementioned Helmholtz resonator b1 (degree of flattening r=1, which means a square shape) in such a manner that the degree of flattening r approaches 0 (zero), and then individually measured the sound pressure P and particle velocity V on the bottom surface X2 (of the cavity opposite from the neck) of each of the Helmholtz resonators b1-1, b1-2, . . . , b1-N with the frequency of the sound source sufficiently lowered. Then, a sum between the additional acoustic masses a 1 and a 2 for each of the Helmholtz resonators b1-1, b1-2, . . . , b1-N is calculated on the basis of the measurements of the sound pressure P and particle velocity V and Mathematical Expression (7) above.

Figure 9:
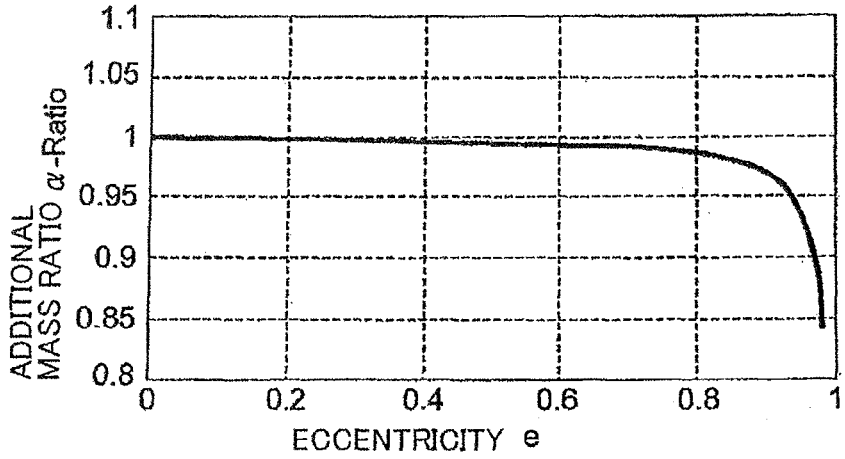
FIG. 9 is a diagram showing relationship between eccentricities and additional mass ratios of Helmholtz resonators.

A graph curve shown in FIG. 9 indicates correspondency relationship between the respective eccentricities e of the Helmholtz resonators a1, a1-1, a1-2, . . . , a1-M and ratios $\alpha$–Ratio calculated by dividing the respective additional acoustic masses $\alpha 1+\alpha 2$ of the Helmholtz resonators a1, a1-1, a1-2, . . . , a1-M by the additional acoustic mass $\alpha 1+\alpha 2$ of the Helmholtz resonator a1. Further, a graph curve shown in FIG. 10 indicates correspondency relationship between the respective degrees of flattening r of the Helmholtz resonators b1, b1-1, b1-2, . . . , b1-N and ratios $\alpha$–Ratio calculated by dividing the additional acoustic masses $\alpha 1+\alpha 2$ of the Helmholtz resonators b1, b1-1, b1-2, . . . , b1-N by the additional acoustic mass $\alpha 1+\alpha 2$ of the Helmholtz resonator b1.

Figure 10:
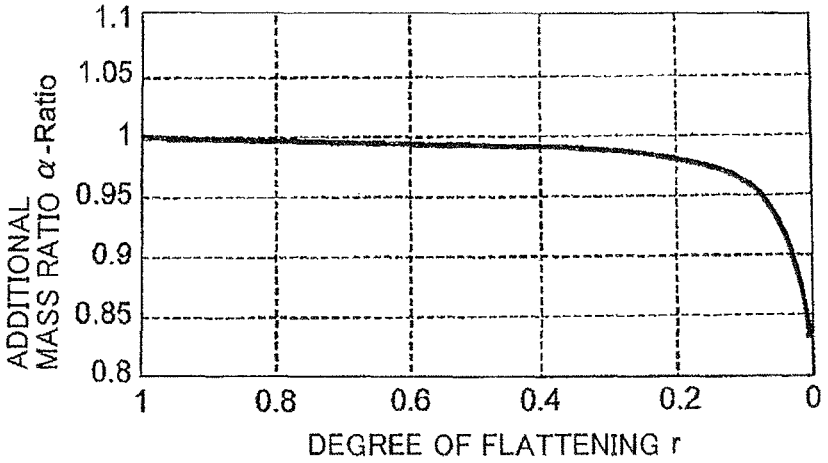
FIG. 10 is a diagram showing relationship between degrees of flattening and additional mass ratios of Helmholtz resonators.

Here, the additional acoustic mass $\alpha 1+\alpha 2$ of the Helmholtz resonator represents a physical amount "$(\alpha 1+\alpha 2)=(m-m')$" that determines the open end correction value $\Delta L$ in Mathematical Expression (2) above, and the open end correction value $\Delta L$ to be used for determining the resonant frequency fr of the Helmholtz resonator by Mathematical Expression (2) increases as the additional acoustic mass $\alpha 1+\alpha 2$ of the Helmholtz resonator increases. Further, for the Helmholtz resonators a1, a1-1, a1-2, . . . , a1-M, as shown in FIG. 9, the additional acoustic mass $\alpha 1+\alpha 2$ decreases as the eccentricity e approaches one. Further, for the Helmholtz resonators b1, b1-1, b1-2, . . . , b1-N, as shown in FIG. 10, the additional acoustic mass $\alpha 1+\alpha 2$ decreases as the degree of flattening r approaches zero. From the foregoing, it can be seen that the additional acoustic mass $\alpha 1+\alpha 2$ increases as the ratio of the minimum value MIN of distances between the center of the cross section of the neck of the Helmholtz resonator and individual points defining the outer periphery of the cross section to the maximum value MAX of the distances (i.e., ratio MIN/MAX) decreases, and that relationship between the ratio MIN/MAX and the additional acoustic mass $\alpha 1+\alpha 2$ is one of factors which cause the resonant frequency fr to vary depending on the cross-sectional shape of the neck of the Helmholtz resonator.

<Second Embodiment>

Figure 11:
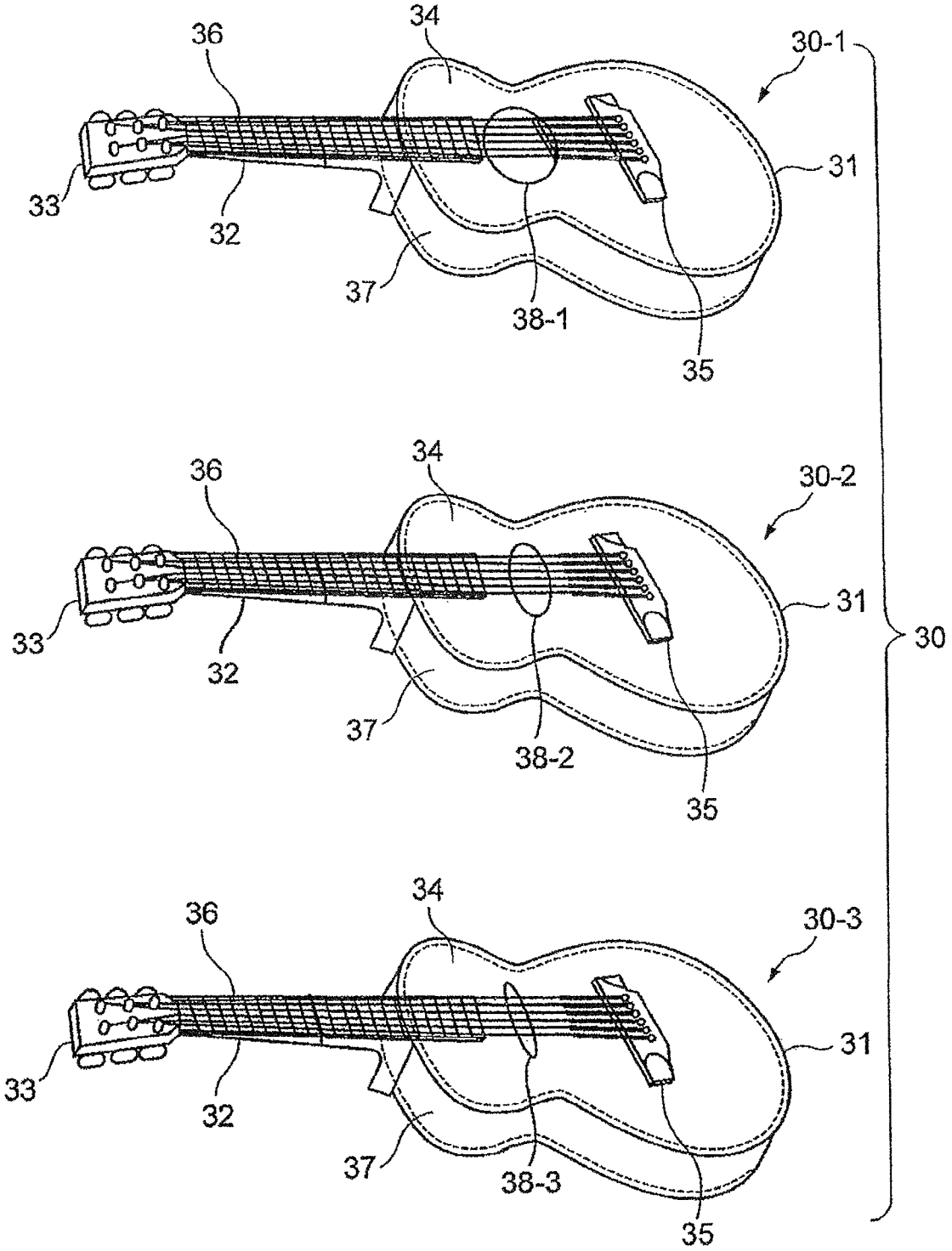
FIG. 11 is a perspective view showing a guitar group that is a second embodiment of the present invention.

FIG. 11 is a perspective view showing a guitar group 30 that is an audio device group according to a second embodiment of the present invention. The guitar group 30 comprises a plurality of types (e.g., three types) of guitars 30-*i* (i=1-3). Each of the guitars 30-*i* includes a neck 32 fixed to and extending from a hollow body 31, strings 36 stretched taut between a head 33 provided at the distal end of the neck 32 and a bridge 35 provided on a front surface plate 34 of the body 31, and a sound hole 38-*i* formed in the front surface plate 34 in communication with a space 37 within the body 31. In this guitar 30-*i*, the sound hole 38-*i* and the space 37 within the body 31 together constitute a Helmholtz resonator, and the sound hole 38-*i* and the space 37 function as the neck and cavity, respectively, of the Helmholtz resonator. Thus, when a sound of the resonant frequency fr of Helmholtz resonance by the sound hole 38-*i* and space 37 is audibly generated by plucking of any one of the strings 36, the sound of the resonant frequency fr is irradiated through the sound hole 38-*i*, so that the sound of the resonant frequency fr can be effectively enhanced.

In the instant embodiment, a cross-sectional area S of the sound hole 38-*i*, length L of the sound hole 38-*i* (i.e., thickness of the front surface plate 34) and volume V of the space 37 are the same among three types of guitars 30-*i* (i=1-3). Further, relationship, among the three types of guitars 30-*i* (i=1-3), of a ratio of a minimum value MIN of distances between the center of gravity of the cross section of the sound hole 38-*i* and individual points defining the outer periphery of the cross section to a maximum value MAX of the distances (i.e., ratio MIN/MAX) is the guitar 30-1>the guitar 30-2>the guitar 30-3. More specifically, as shown in FIG. 11, the cross section of the sound hole 38-1 of the guitar 30-1 has a perfect circular shape, the cross section of the sound hole 38-2 of the guitar 30-2 has an elliptical shape, and the cross section of the sound hole 38-3 of the guitar 30-3 has an elliptical shape more flattened than that of the sound hole 38-2.

Because of such different cross-sectional shapes of the sound holes 38-*i* (i=1-3), sounds of different frequencies Fr can be enhanced with the guitars 30-*i* (i=1-3). With this modification too, it is possible to make guitars 30-*i* (i=1-3) that generate Helmholtz resonance at different frequencies, without involving increase in a burden for designing and making individual ones of the guitars 30-*i* (i=1-3).

<Third Embodiment>

Figure 12:
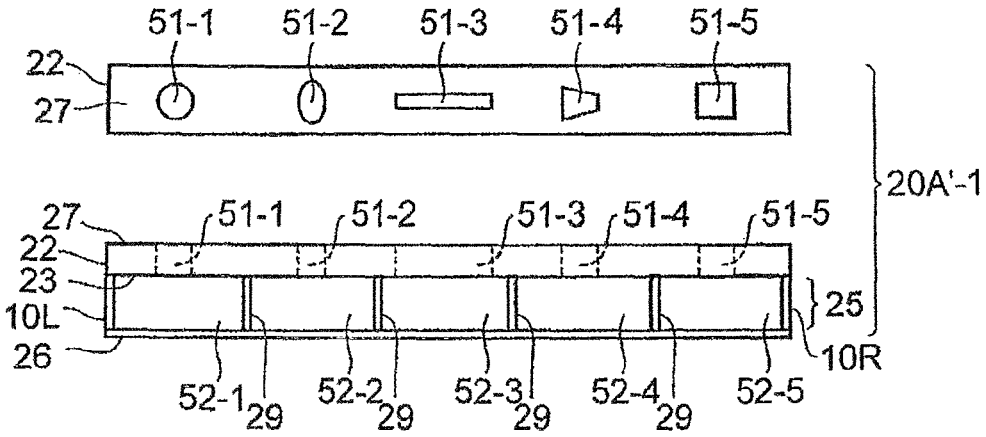
FIG. 12 is a view of a sound absorbing panel that is a third embodiment of the present invention.

FIG. 12 shows a front view of a sound absorbing panel 50 that is a third embodiment of the present invention and a sectional view of the sound absorbing panel 50 taken along the C-C' line. According to the third embodiment, the sound absorbing panel 50 is provided with a plurality of (five in the illustrated example of FIG. 12) Helmholtz resonators. The cross-sectional area of the neck and the volume of the cavity are the same between at least two of the Helmholtz resonators (same among all of the five Helmholtz resonators in the illustrated example of FIG. 12), but the ratio of the minimum value of distances between the center of gravity of the cross section of the neck and individual points defining the outer periphery of the cross section to the maximum value of the distances is different between at least two of the Helmholtz resonators (different among individual ones of the five Helmholtz resonators in the illustrated example of FIG. 12).

As a modification of the first embodiment, one sound absorbing panel 20A'-m (e.g., sound absorbing panel 20A'-1) may have five holes 51-*j* (j=1-5) of different cross-sectional shapes formed in the thin plate 22, as shown in FIG. 12. Namely, the one sound absorbing panel 20A'-m is provided with a plurality of Helmholtz resonators of different characteristics. In other words, a plurality of audio devices of different characteristics are incorporated in a single acoustic structure (i.e., sound absorbing panel 20A'-m). More specifically, holes 51-*j* (j=1-5) having circular, elliptical, elongated rectangular, trapezoidal and square cross-sectional shapes are formed in the thin plate 22 of the sound absorbing panels 20A'-1. The cross-sectional area S and length L of the hole 51-*j* are the same among the five holes 51-*j* (j=1-5). Further, in the sound absorbing panel 20A'-1, the thin plate 22 is spaced opposed to the back surface plate 26, via the left side surface plate 10L, right side surface plate 10R, front side surface plate (not shown) and rear side surface plate (not shown), to define the air layer 25 surrounded by the six plates. Furthermore, in the sound absorbing panels 20A'-1, the air layer 25 between the thin plate 22 and the back surface plate 26 is partitioned into five spaces 52-*j* (j=1-5) each having a same volume V and these spaces 52-*j* (j=1-5) are in communication with the outside.

In the sound absorbing panel 20A'-1, five Helmholtz resonators are composed of the five holes 51-*j* (j=1-5) and spaces 52-*j* (j=1-5). The holes 51-*j* (j=1-5) and spaces 52-*j* (j=1-5) function as necks and cavities, respectively, of the five Helmholtz resonators. The five Helmholtz resonators generate Helmholtz resonance at frequencies corresponding to the cross-sectional shapes of the holes 51-*j*. In the sound absorbing panel 50, whereas the cross-sectional area of the neck and the volume of the cavity are the same among all of the five Helmholtz resonators, the ratio of the minimum value of distances between the center of gravity of the cross section of the neck and individual points defining the outer periphery of the cross section to the maximum value of the distances is different among the individual ones of the five Helmholtz resonators. In this way, the five Helmholtz resonators in the sound absorbing panel 50 resonate at different frequencies. Thus, the sound absorbing panel 50 can absorb sounds of wide frequency bands from low to high frequencies.

<Fourth Embodiment>

Figure 13:
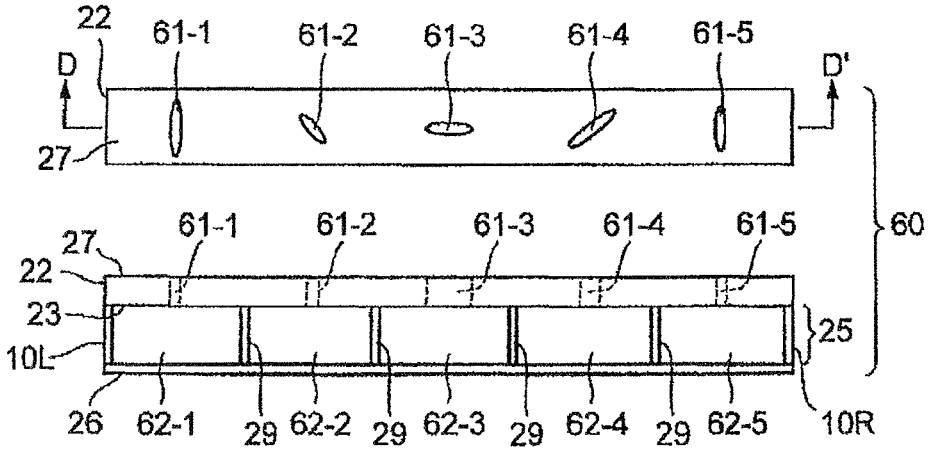
FIG. 13 is a view of a sound absorbing panel that is a fourth embodiment of the present invention.

FIG. 13 shows a front view of a sound absorbing panel 60 that is a fourth embodiment of the present invention and a sectional view of the sound absorbing panel 60 taken along the D-D' line. According to the fourth embodiment, the sound absorbing panel 60 has five holes 61-*j* (j=1-5) formed in the thin plate 22. The holes 61-*j* (j=1-5) are each of an elliptical shape such that the eccentricity e of the cross section, calculated by substituting into Mathematical Expression (3) above the minimum and maximum values MIN and MAX of distances between the center of the cross section of the hole 61-*j* and individual points defining the outer periphery of the cross section, is greater than 0.9. Relationship, among the elliptical holes 61-*j* (j=1-5), of the respective eccentricities e is 61-4>61-1>61-3>61-5>61-2. Further, the cross-sectional area S and length L of the hole 61-*j* are the same among all of the five holes 61-*j* (j=1-5). In this sound absorbing panel 60, the air layer 25 between the thin plate 22 and the back surface plate 26 is partitioned, by four partition plates 29 parallel to the left side surface plate 10L and right side surface plate 10R, into five spaces 62-*j* (j=1-5) each having the same volume V.

In the sound absorbing panel 60, five Helmholtz resonators are formed by the holes 61-*j* (j=1-5) and spaces 62-*j* (j=1-5). The holes 61-*j* (j=1-5) and spaces 62-*j* (j=1-5) function as the necks and cavities, respectively, of the Helmholtz resonators. The five Helmholtz resonators generate Helmholtz resonance at frequencies corresponding to the shapes of the cross sections of the holes 61-*j* (j=1-5) functioning as the Helmholtz resonator necks. Thus, the sound absorbing panel 60 too can absorb sounds of wide frequency bands from low to high frequencies. Further, because the eccentricities e of the neck's cross sections of the five Helmholtz resonators are greater than 0.9 as noted above, the sound absorbing panel 60 can absorb sounds of higher frequencies with higher accuracy than a construction where smaller eccentricities e are employed.

Here, any one of the resonant frequencies of the sound absorbing panel 60 can be shifted to a higher frequency region by three technical means: reducing the length of the hole 61-*j* (neck length); reducing the volume of the space 62-*j* (cavity volume); and reducing the cross-sectional area of the hole 61-*j* (neck's cross-sectional area). However, in audio devices, like the sound absorbing panel 60, of which outside-dimension designing limitations are strict, the first two of the above-mentioned three technical means are difficult to employ. The reduction of the neck's cross-sectional area, on the other hand, does not substantially influence the outside dimensions and thus is easy to employ as compared to the reduction of the neck length and cavity volume. But, in the case of sound absorbing panels, if the cross-sectional area of the hole 61-*j* is reduced, an inner wall surface defining the hole 61-*j* would decrease in area, and thus, viscous resistance of the inner wall surface increases, which would undesirably result in a decreased sound absorbing force (decreased peak value of a sound absorption coefficient). By contrast, the instant embodiment can eliminate the need for reducing the area of the inner wall surface of the hole 61-*j*, and thus, it can shift the resonant frequency to a higher frequency region without involving undesirable reduction of the sound absorbing force.

<Fifth Embodiment>

Figure 14:
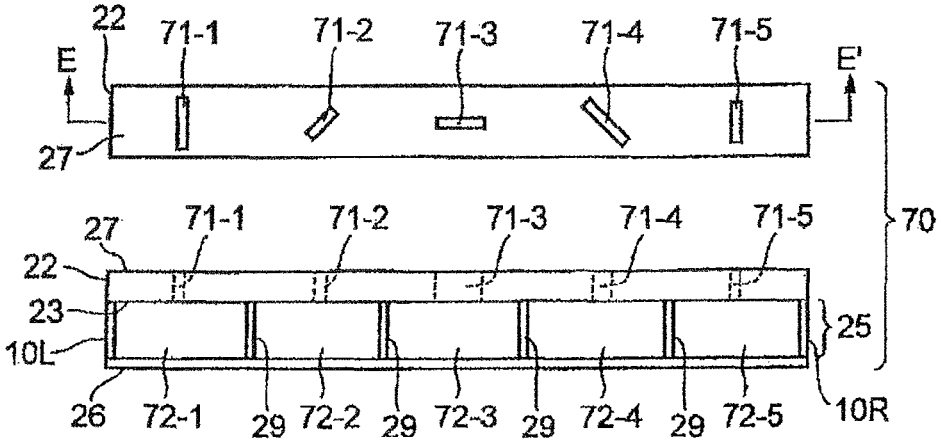
FIG. 14 is a view of a sound absorbing panel that is a fifth embodiment of the present invention.

FIG. 14 shows a front view of a sound absorbing panel 70 that is a fifth embodiment of the present invention and a sectional view of the sound absorbing panel 70 taken along the E-E' line. According to the fifth embodiment, the sound absorbing panel 70 has five holes 71-*j* (j=1-5) formed in the thin plate 22. The holes 71-*j* (j=1-5) are each of an elongated rectangular shape such that the degree of flattening r, determined by substituting into Mathematical Expression (4) above the short-side length X and long-side length Y of the cross section of the hole 71-*j*, is smaller than 0.1. Relationship, among the holes 71-*j* (j=1-5), of the respective degrees of flattening r is 71-4<71-1<71-3<71-5<71-2. Further, the cross-sectional area S and length L of the hole 71-*j* is the same among all of the five holes 71-*j* (j=1-5). In this sound absorbing panel 70, the air layer 25 between the thin plate 22 and the back surface plate 26 is partitioned, by four partition plates 29 parallel to the left side surface plate 10L and right side surface plate 10R, into five spaces 72-*j* (j=1-5) each having the same volume V. This embodiment can achieve the same advantageous benefits as the fourth embodiment.

<Sixth Embodiment>

Figure 15:
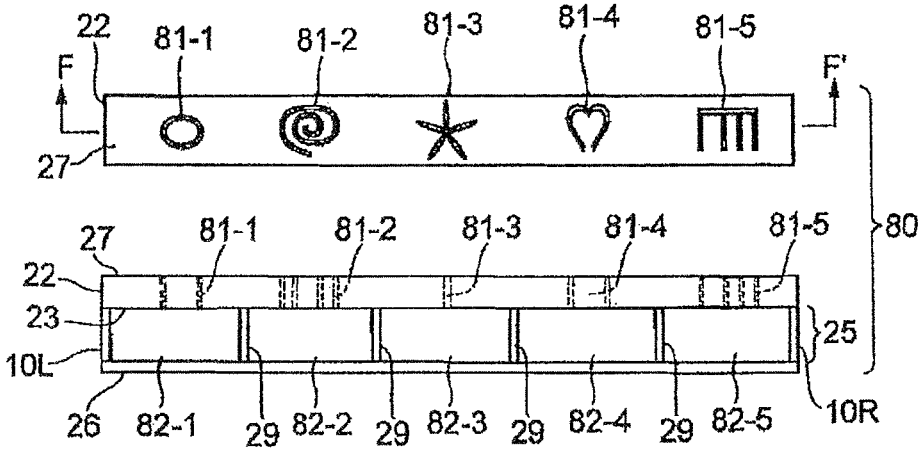
FIG. 15 is a view of a sound absorbing panel that is a sixth embodiment of the present invention.

FIG. 15 shows a front view of a sound absorbing panel 80 that is a sixth embodiment of the present invention and a sectional view of the sound absorbing panel 80 taken along the F-F' line. According to the sixth embodiment, the sound absorbing panel 80 has five holes 81-*j* (j=1-5) formed in the thin plate 22. Of these 81-*j* (j=1-5), the hole 81-1 has a shape simulating the outline of an English alphabet "O", the hole 81-2 has a shape simulating a whorl, the hole 81-3 has a shape simulating a starfish, the hole 81-4 has a shape simulating the outline of a heart mark, and the hole 81-5 has a shape simulating a comb. The cross-sectional area S and length L of the hole 81-*j* are the same among all of the five holes 81-*j* (j=1-5). In this sound absorbing panel 80, the air layer 25 between the thin plate 22 and the back surface plate 26 is partitioned, by four partition plates 29 parallel to the left side surface plate 10L and right side surface plate 10R, into five spaces 82-*j* (j=1-5) each having the same volume V. This embodiment too can achieve the same advantageous benefits as the fourth embodiment. With the six embodiment, holes capable of achieving the same advantageous benefits as the holes of cross-sectional shapes having great eccentricities e in the above-described fourth embodiment and the holes of cross-sectional shapes having small degrees of flattening r in the above-described fifth embodiment can be provided in the thin plate 22 with an increased efficiency.

<Seventh Embodiment>

Figure 16:
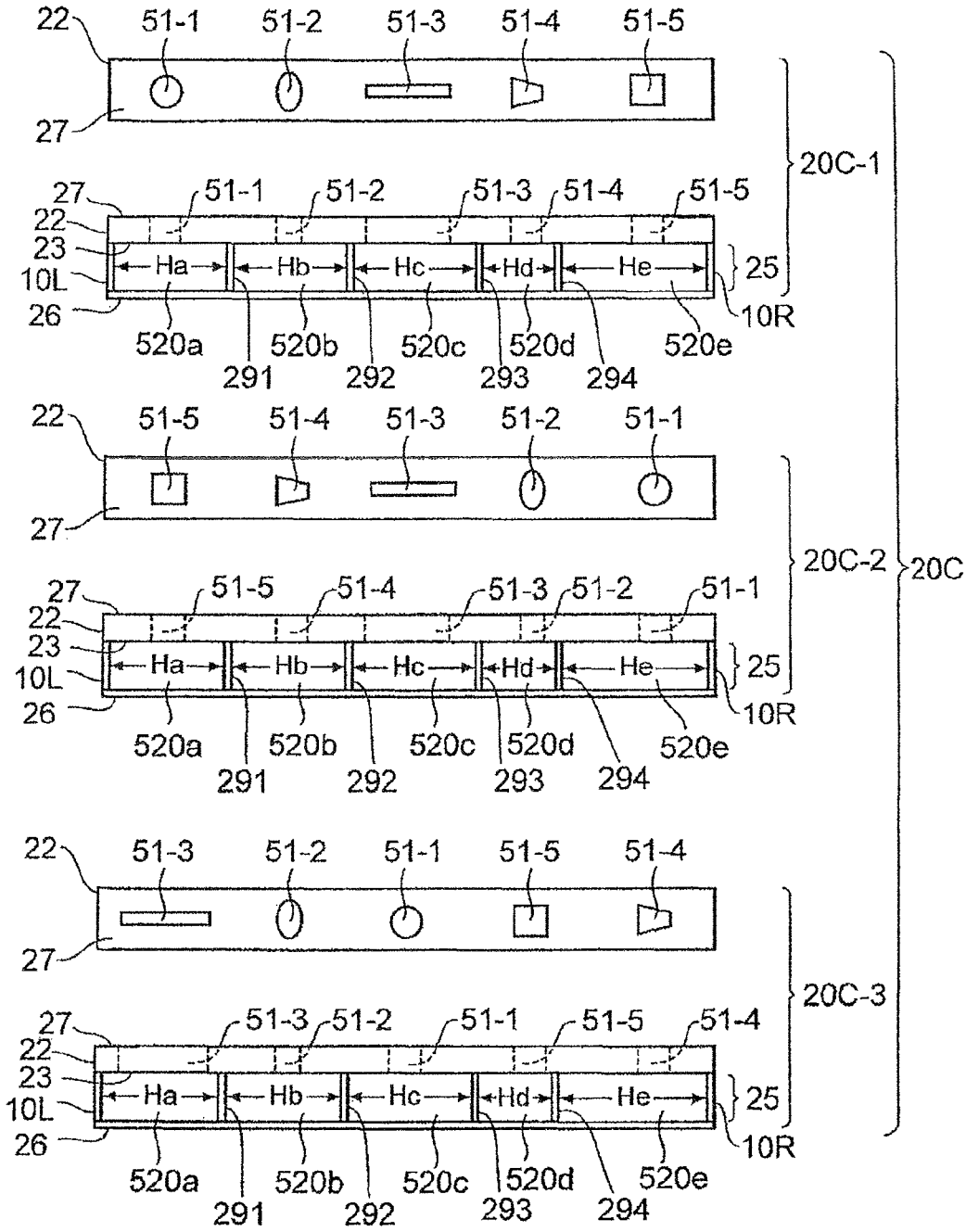
FIG. 16 is a view of a sound absorbing panel group that is a seventh embodiment of the present invention.

FIG. 16 is a view showing a construction of a sound absorbing panel group 20C that is a seventh embodiment of the present invention. In the above-described first embodiment, the five Helmholtz resonators provided in each of the three types of sound absorbing panels 20A-m (m=1-3) are constructed in such a manner that the cross-sectional area S and length L of the neck and the volume of the cavity are the same among all of the three types but the cross-sectional shape of the neck is different among individual ones of the three types. In the seventh embodiment, on the other hand, the neck's cross-sectional areas and lengths and the cavity's volumes of two of the five Helmholtz resonators are the same among the three types of sound absorbing panels 20C-m (m=1-3) with the neck's cross-sectional shapes of the two Helmholtz resonators being different among the three types.

More specifically, in each of the sound absorbing panels 20C-m (m=1-3) of the sound absorbing panel group 20C, the thin plate 22 and the back surface plate 26 are spaced opposed to each other via the left side surface plate 10L, right side surface plate 10R, front side surface plate (not shown) and rear side surface plate (not shown), and the air layer 25 surrounded by these plates is partitioned, by four partition plates 291, 292, 293 and 294, into five spaces 520*a*, 520*b*, 520*c*, 520*d* and 520*e*. An interval Ha between the plate 10L and the plate 291 and an interval Hb between the plate 291 and the plate 292 are equal to each other in each of the three types of sound absorbing panels 20C-m (m=1-3). Further, an interval Hd between the plate 293 and the plate 294 is smaller than the interval Ha and the interval Hb. Further, an interval Hc between the plate 292 and the plate 293 is smaller than the interval Ha, interval Hb and interval Hd. Furthermore, an interval He between the plate 294 and the plate 10R is smaller than the interval Ha, interval Hb, interval Hc and interval Hd. Thus, relationship, among volumes Va, Vb, Vc, Vd and Ve, of the spaces 520*a*, 520*b*, 520*c*, 520*d* and 520*e* in the three types of sound absorbing panels 20C-m (m=1-3) is Vd<Va=Vb<Vc<Ve.

Of the sound absorbing panels 20C-m (m=1-3), the sound absorbing panel 20C-1 has holes 51-1, 52-2, 51-3, 51-4 and 51-5 formed in a left-right arrangement or row in its thin plate 22, The hole 51-1 has a perfect circular shape, the hole 51-2 has an elliptical shape, the hole 51-3 has an elongated rectangular shape, the hole 51-4 has a trapezoidal shape, and the hole 51-5 has a square shape. All of these holes 51-*i* (i=1-5) have the same length (i.e., same neck length). Further, the hole 51-1 located leftmost in the left-right row is in communication with the space 520*a*, the hole 51-2 located to the right of the leftmost hole 51-1 is in communication with the space 520*b*, the hole 51-3 located to the right of the hole 51-2 is in communication with the space 520*c*, the hole 51-4 located to the right of the hole 51-3 is in communication with the space 520*d*, and the hole 51-5 located rightmost in the left-right row is in communication with the space 520*e*, In the sound absorbing panel 20C-1, a first Helmholtz resonator is constructed of the hole 51-1 and space 520*a*, a second Helmholtz resonator is constructed of the hole 51-2 and space 520*b*, a third Helmholtz resonator is constructed of the hole 51-3 and space 520*c*, a fourth Helmholtz resonator is constructed of the hole 51-4 and space 520*d*, and a fifth Helmholtz resonator is constructed of the hole 51-5 and space 520*e*.

The sound absorbing panel 20C-2 has holes 51-5, 51-4, 51-3, 51-2 and 51-1 formed in a left-right arrangement or row in its thin plate 22, The hole 51-5 located leftmost in the left-right row is in communication with the space 520*a*, the hole 51-4 located to the right of the leftmost hole 51-5 is in communication with the space 520*b*, the hole 51-3 located to the right of the hole 51-4 is in communication with the space 520*c*, the hole 51-2 located to the right of the hole 51-3 is in communication with the space 520*d*, and the hole 51-1 located rightmost in the left-right row is in communication with the space 520*e*, In the sound absorbing panel 20C-2, a first Helmholtz resonator is constructed of the hole 51-5 and space 520*a*, a second Helmholtz resonator is constructed of the hole 51-4 and space 520*b*, a third Helmholtz resonator is constructed of the hole 51-3 and space 520*c*, a fourth Helmholtz resonator is constructed of the hole 51-2 and space 520*d*, and a fifth Helmholtz resonator is constructed of the hole 51-1 and space 520*e*.

Further, the sound absorbing panel 20C-3 has holes 51-3, 51-2, 51-1, 51-5 and 51-4 formed in a left-right arrangement or row in its thin plate 22, The hole 51-3 located leftmost in the left-right row is in communication with the space 520*a*, the hole 51-2 located to the right of the leftmost hole 51-3 is in communication with the space 520*b*, the hole 51-1 located to the right of the hole 51-2 is in communication with a space 520*c*, the hole 51-5 located to the right of the hole 51-2 is in communication with a space 520*d*, and the hole 51-4 located rightmost in the left-right row is in communication with the space 520*e*, In the sound absorbing panel 20C-3, a first Helmholtz resonator is constructed of the hole 51-3 and space 520*a*, a second Helmholtz resonator is constructed of the hole 51-2 and space 520*b*, a third Helmholtz resonator is constructed of the hole 51-1 and space 520*c*, a fourth Helmholtz resonator is constructed of the hole 51-5 and space 520*d*, and a fifth Helmholtz resonator is constructed of the hole 51-4 and space 520*e*.

For the first and second Helmholtz resonators in the three types of sound absorbing panels 20A-m (m=1-3), the cross-sectional area and length of the neck and the volume of the cavity are the same among the three types, but the cross-sectional shape of the neck is different among individual ones of the three types. Namely, the neck's cross-sectional areas and lengths and the cavity's volumes of the first and second Helmholtz resonators are the same among the three types of sound absorbing panels 20A-m (m=1-3) with the neck's cross-sectional shapes of the first and second Helmholtz resonators being different among the three types. Thus, the resonant frequencies of the first and second Helmholtz resonators differ among the three types of sound absorbing panels 20A-m (m=1-3). Therefore, even in a case where there are designing limitations requiring that dimensions determining the resonant frequencies of the first and second Helmholtz resonators in the three types of sound absorbing panels 20A-m (m=1-3) (i.e., dimensions determining the neck's cross-sectional areas S and lengths L and the cavity's volumes V of the first and second Helmholtz resonators) be the same among all of the three types of sound absorbing panels 20A-m (m=1-3), the instant embodiment allows the Helmholtz resonators, provided in the three types of sound absorbing panels 20A-m (m=1-3), to absorb sounds of different frequencies. The foregoing has described above the seventh embodiment in relation to the case where the neck's cross-sectional areas and lengths and the cavity's volumes of the first and second Helmholtz resonators are the same among the three types of sound absorbing panels 20A-m (m=1-3) but the neck's cross-sectional shapes of the first and second Helmholtz resonators are different among the three types. As a modification of the seventh embodiment, however, the neck's cross-sectional areas and lengths and the cavity's volumes of the first to third Helmholtz resonators may be the same among the three types of sound absorbing panels 20A-m (m=1-3) with the neck's cross-sectional shapes of the first to third Helmholtz resonators being differentiated among the three types. In short, it is only necessary for the seventh embodiment to be constructed in such a manner that the Helmholtz resonators provided in a plurality of types of audio devices include at least two Helmholtz resonators of which the cross-sectional area and length of the neck and the volume of the cavity are the same among the plurality of types while the cross-sectional shape of the neck is different among the plurality of types.

<Other Embodiments>

Whereas the foregoing have described in detail the first to seventh embodiments of the present invention, various other embodiments and modifications of the invention are also possible as exemplified below.

(1) As a modification of the above-described second embodiment, the sound holes 38-*i* (i=1-3) may be of a rectangular shape. In this case, the ratio of the minimum value MIN of the distances between the center of gravity of the cross section of the sound hole 38-*i* and individual points defining the outer periphery of the cross section to a maximum value MAX of the distances (i.e., ratio MIN/MAX) may be set at a smaller value for the guitar 30-*i* that should enhance a sound of a higher frequency.

Figure 17A:
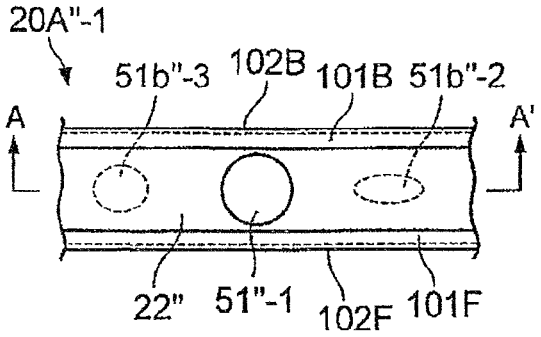
FIGS. 17A to 17E are an external appearance view, sectional view and left side view of a sound absorbing panel that is another modification of the present invention.
Figure 17B:
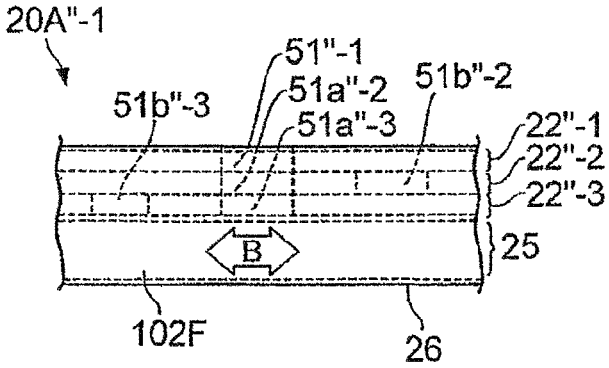
Figure 17C:
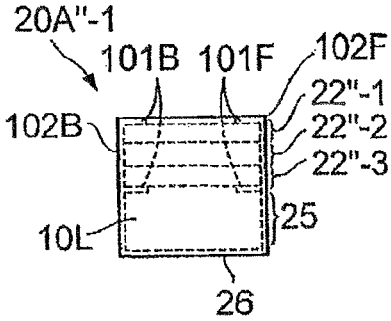
Figure 17D:
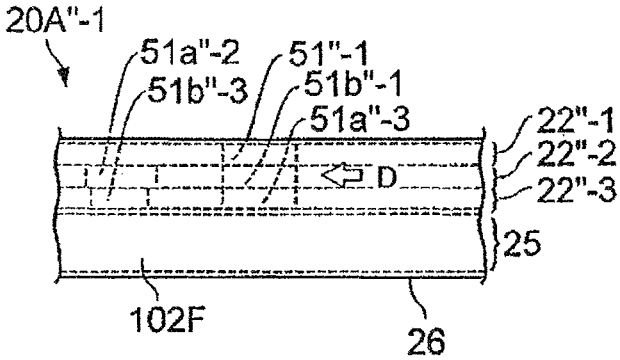

(2) As a modification of the above-described first and second embodiments, the sound absorbing panels 20A-m and 20B-n and guitars 30-*i* may include a mechanism for varying the cross-sectional shape of the neck of the Helmholtz resonator provided therein. For example, at least one type of sound absorbing panel 20A-m may include a plurality of layers of thin plates 22 having holes 51 of different shapes 51, and a support means that supports the plurality of layers of thin plates 22 in such a manner that the layers are slidable relative to one another. FIG. 17A is a plan view showing such a modified sound absorbing panel 20A"-1 and particularly a portion thereof around the holes, FIG. 17B is a sectional view of the sound absorbing panel 20A"-1 taken along the A-A' line of FIG. 17A, and FIG. 17C is a left side view of the sound absorbing panel 20A"-1. As shown in FIGS. 17A, 17B and 17C, the sound absorbing panel 20A"-1 comprises three layers of thin plates 22"-*i* (i=1-3). Of the three layers of thin plates 22"-*i* (i=1-3), the back surface, opposite from the layer of thin plate 22"-2, of the layer of thin plate 22"-3 is opposed to the back surface plate 26 via the space 25. The three layers of thin plates 22"-*i* (i=1-3) are sandwiched in a front-rear direction by rails 101F and 101B, projecting in a U shape, of two side surface plates 102F and 102B. The thin plates 22"-*i* are slidable along the rails 101F and 101B in their extending directions (i.e., in a direction of white arrow B in FIG. 17B). Further, the side surface plate 10L is joined to the left ends of the thin plates 22"-*i* (i=1-3), bottom plate 26 and side surface plates 102F and 102B, and the side surface plate 10R (not shown in FIG. 17) is joined to the right ends of the thin plates 22"-*i* (i=1-3), bottom plate 26 and side surface plates 102F and 102B.

A hole 51"-1 having a cross-sectional area S1 is formed in the thin plate 22"-1, and this hole 51"-1 has a perfect circular shape. A hole 51*a*"-2 having a cross-sectional area S1 and a hole 51*b*"-2 having a cross-sectional area S2 (S2<S1) are formed in the thin plate 22"-2 and spaced from each other in the extending direction of the thin plate 22"-2. The hole 51*a*"-2 has a perfect circular shape of the same size as the hole 51"-1, and the hole 51*b*"-2 has an elliptical shape, whose long axis has a length substantially equal to the diameter of the hole 51"-1. A hole 51*a*"-3 having a cross-sectional area S1 and a hole 51*b*"-3 having a cross-sectional area S2 are formed in the thin plate 22"-3 and spaced from each other in the extending direction of the thin plate 22"-3. The hole 51*a*"-3 has a perfect circular shape of the same size as the hole 51"-1, and the hole 51*b*"-3 has an elliptical shape, whose long axis has a length smaller than that of the long axis of the hole 51*b*"-2. The short axis of the hole 51*b*"-3 is greater than the short axis of the hole 51*b*"-2.

Figure 17E:
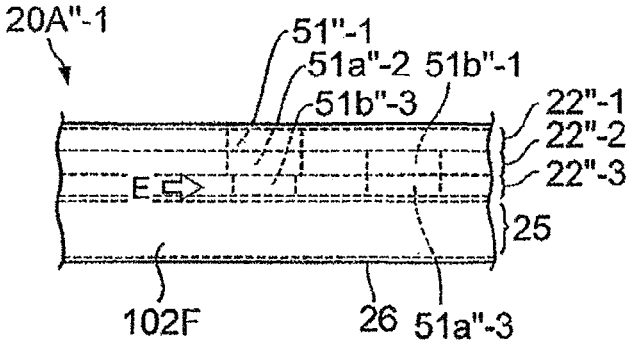

In the sound absorbing panel 20A"-1, a Helmholtz resonator is provided in which a neck is constituted by an overlapping section among the hole 51"-1 of the thin plate 22"-1, hole 51*a*"-2 or hole 51*b*"-2 of the thin plate 22"-2 and hole 51*a*"-3 or hole 51*b*"-3 of the thin plate 22"-3 while a cavity is constituted by the air layer 25 surrounded by the thin plate 22"-3, back surface plate 26 and side surface plates 101F, 101B, 10L and 10R. The overlapping section functioning as the neck of the Helmholtz resonator takes different cross-sectional shapes when the thin plate 22"-2 has been slid in a direction of arrow D such that the holes 51"-1, 51*b*"-2 and 51*a*"-3 overlap one another (FIG. 17D) and when the thin plate 22"-3 has been slid in a direction of arrow E such that the holes 51"-1, 51*a*"-2 and 51*b*"-3 overlap one another (FIG. 17E). Thus, according this modification, the sound absorbing panel 20A"-1, which is an audio device, is allowed to resonate at a plurality of frequencies and thus absorb sounds of wide frequency bands. Note that the cross-sectional shape may be varied by replacing the neck with another neck having a different cross-sectional shape.

(3) As a modification of the above-described second embodiment, any of a plurality of sound holes 38-*i* of different cross-sectional area S may be detachably attached to the guitar 30-*i*.

(4) As a modification of the above-described first embodiment, the number of sound absorbing panels 20A-m (m=1-3) constituting an audio device group may be two or four or more. In this case, M' types of sound absorbing panels 20A-m (m=1, 2, . . . M'), which constitute an audio device group, may include at least one type of sound absorbing panel 20A-m which has a circular or elliptical hole 21A-m (neck) whose eccentricity e of the cross section is smaller than 0.9 and at least one type of sound absorbing panel 20A-m which has an elliptical hole 21A-m (neck) whose eccentricity e of the cross section is greater than 0.9. As shown in FIG. 9, the acoustic additional mass ratio $\alpha$–Ratio of the Helmholtz resonators a1-1, a1-2, . . . , a1-M with the eccentricity e varied within a range of 0<e<1 rapidly lowers once the eccentricity e exceeds 0.9. Thus, according to this modification, there can be provided an audio device group whose resonant frequencies fr are distributed over wider frequency bands than an audio device group comprising only a plurality of types of absorbing panels 20A-m each having an eccentricity e smaller than 0.9 and an audio device group comprising only a plurality of types of absorbing panels 20A-m each having an eccentricity e greater than 0.9.

(5) As a modification of the above-described first embodiment, the number of sound absorbing panels 20B-n (n=1-3) constituting an audio device group may be two or four or more. In this case, N' types of sound absorbing panels 20B-n (n=1, 2, . . . , N'), which constitute an audio device group, may include at least one type of sound absorbing panel 20B-n which has an elongated rectangular hole 21B-n (neck) whose degree of flattening r of the cross section is smaller than 0.1 and at least one type of sound absorbing panel 20B-n which has an elongated rectangular or square hole 21B-n (neck) whose degree of flattening r of the cross section is greater than 0.1. As shown in FIG. 10, the acoustic additional mass ratio α–Ratio of the Helmholtz resonators b1-1, b1-2, . . . , b1-N with the degree of flattening r varied within a range of 1>r>0 rapidly lowers once the degree of flattening r falls below 0.1. Thus, according to this modification, there can be provided an audio device group whose resonant frequencies fr are distributed over wider frequency bands than an audio device group comprising only a plurality of types of absorbing panels 20B-n each having a degree of flattening r smaller than 0.1 and an audio device group comprising only a plurality of types of absorbing panels 20B-n each having a degree of flattening r greater than 0.1.

(6) Where a sound of a sufficiently high frequency is to be absorbed in the first embodiment, there may be provided only a sound absorbing panel 20A-m which has a hole 21A-m (neck) having an elliptic cross-sectional shape and having an eccentricity e, calculated by substituting, into Mathematical Expression (3) above, minimum and maximum values MIN and MAX of distances between the center of the cross section of the hole 21A-m (neck) and individual points defining the outer periphery of the cross section, is greater than 0.9. Conceptually stated, such a sound absorbing panel is one which has a hole having an elliptic cross-sectional shape and having an eccentricity e, calculated by substituting, into Mathematical Expression (3) above, minimum and maximum values MIN and MAX of distances between the center of the cross section of the hole (neck) and individual points defining the outer periphery of the cross section, is greater than 0.9.

Similarly, where a sound of a sufficiently high frequency is to be absorbed in the second embodiment, there may be provided only a sound absorbing panel 20B-n which has a hole 21B-n (neck) having an elongated rectangular cross-sectional shape and having a degree of flattening r calculated by substituting, into Mathematical Expression (4) above, the short side length X and long side length Y of the cross section of the hole 21B-n, is smaller than 0.1. Conceptually stated, such a sound absorbing panel is one which has a hole of an elongated rectangular cross-sectional shape and has a degree of flattening r calculated by substituting, into Mathematical Expression (4) above, the short side length X and long side length Y of the cross section of the hole 21B-n, is smaller than 0.1.

Such two modifications or modified embodiments are useful as technical means for solving the following problems. Up to this day, as a means for shifting a resonant frequency of a Helmholtz resonator provided on an audio device to a higher frequency region, there has been employed any one of the following three measures: reducing the length of the neck; reducing the volume of the cavity; and reducing the cross-sectional area of the neck. However, in audio devices, such as sound absorbing panels, of which outer-appearance designing limitations are strict, the first two of the above three measures are difficult to employ. On the other hand, reduction of the cross-sectional area of the neck can be employed relatively easily as compared to reduction of the neck length and cavity volume because the reduction of the cross-sectional area of the neck does not so much influence the outer dimensions of the audio device. However, in the case of the sound absorbing panel, if the cross-sectional area of the hole, functioning as the neck, is reduced, an inner wall surface defining the hole would decrease in area, and thus, viscous resistance of the inner wall surface increases, which would undesirably result in a decreased sound absorbing force (decreased peak value of a sound absorption coefficient). By contrast, the instant modified embodiments, which can eliminate the need for reducing the area of the inner wall surface, can shift only the resonant frequency to a higher frequency region without involving undesirable reduction of the sound absorbing force.

(7) In the above-described seventh embodiment, the air layer 25 surrounded by the thin plate 22 and the back surface plate 26 is partitioned, by the four partition plates 291, 292, 293 and 294, into the five spaces 520*a*, 520*b*, 520*c*, 520*d* and 520*e*. Alternatively, however, the partition plates 291, 292, 293 and 294 may be dispensed with; in this case, it may be assumed that virtual partition plates are provided in the air layer 25 as in the above-described first embodiment (FIGS. 1 and 2).

(8) In the above-described fourth embodiment, the holes 61-*j* (j=1-5) of the sound absorbing panel 60 each have an elliptical shape such that the eccentricity e of the cross section is greater than 0.9. Alternatively, however, only one or some (at least one or more) of the holes 61-*j* (j=1-5) may be of an elliptical shape such that the eccentricity e of the cross section is greater than 0.9.

(9) In the above-described fifth embodiment, the holes 71-*j* (j=1-5) of the sound absorbing panel 70 are each of an elongated rectangular shape such that the degree of flattening r is smaller than 0.1. Alternatively, however, only one or some (at least one or more) of the holes 71*j* (j=1-5) may be of an elongated rectangular shape such that the degree of flattening r is smaller than 0.1.

The present application is based on, and claims priorities to, Japanese Patent Application No. 2010-182270 filed on Aug. 17, 2010 and Japanese Patent Application No. 2011-174929 filed on Aug. 10, 2011. The disclosure of the priority applications, in its entirety, including the drawings, claims, and the specification thereof, is incorporated herein by reference.

What is claimed is:

1. A sound absorbing panel comprising:

at least first and second Helmholtz resonators, the first Helmholtz resonator including a first cavity; and a first neck communicating with the first cavity to propagate a sound into the first cavity through the first neck, and the second Helmholtz resonator including a second cavity; and a second neck communicating with the second cavity to propagate a sound into the second cavity through the second neck, wherein the first cavity and the second cavity are identical to each other in volume, wherein the first neck and the second neck are identical to each other in cross-sectional area, wherein the first neck and the second neck are different from each other in cross-sectional shape, and wherein the cross-sectional shapes of the first and second necks are an elliptical shape and a perfect circular shape, respectively, and wherein an eccentricity e obtained, for each of the first and second necks, by substituting, into a mathematical expression of $e=\{(MAX^2-MIN^2)^{1/2}\}/MAX$, minimum and maximum values of distances between a center of gravity of a cross section of the neck and individual points defining an outer periphery of the cross section is different between the first and second Helmholtz resonators, where MIN denotes the minimum value and MAX denotes the maximum value.

2. The sound absorbing panel as claimed in claim 1, wherein the eccentricity e in at least one of said first and second Helmholtz resonators is greater than 0.9.

3. The sound absorbing panel as claimed in claim 1, wherein the first and second Helmholtz resonators are incorporated in a single acoustic structure.

4. The sound absorbing panel as claimed in claim 1, wherein at least one of the first and second Helmholtz resonators includes a mechanism for varying the cross-sectional shape of the neck.

5. The sound absorbing panel as claimed in claim 1, wherein, in at least one of the first and second Helmholtz resonators, the neck is detachably attachably provided and replaceable with a neck having a different cross-sectional shape.

6. A sound absorbing panel group comprising a plurality of sound absorbing panels each constructed as the sound absorbing panel according to claim 1, wherein, whereas the cross-sectional area of the neck and the volume of the cavity communicating with the neck for each of said first and second Helmholtz resonators are same between the plurality of sound absorbing panels, at least one of the cross-sectional shapes of the first and second Helmholtz resonators is different between at least two of the plurality of sound absorbing panels.

7. The sound absorbing panel as claimed in claim 1, wherein the first neck and the second neck are identical to each other in length.

8. A sound absorbing panel provided with a Helmholtz resonator, wherein the Helmholtz resonator includes a neck and a cavity communicating with the neck, and wherein any one of a plurality of types of necks is detachably attachably provided in the Helmholtz resonator, and, whereas a cross-sectional area and length of the neck are same between the plurality of types, a cross-sectional shape of the neck is different between individual ones of the types, and a volume of the cavity does not vary regardless of the type of the neck attached to the cavity of the Helmholtz resonator, wherein the cross-sectional shape of the neck is an elliptical or perfect circular shape, and wherein an eccentricity e obtained by substituting, into a mathematical expression of $e=\{(MAX^2-MIN^2)^{1/2}\}/MAX$, minimum and maximum values of distances between a center of gravity of a cross section of the neck and individual points defining an outer periphery of the cross section is different between individual ones of the plurality of types of necks, where MIN denotes the minimum value and MAX denotes the maximum value.

9. A sound absorbing panel group comprising:

at least a first type of sound absorbing panel and a second type of sound absorbing panel, the first type of sound absorbing panel being provided with at least a first Helmholtz resonator, and the second type of sound absorbing panel being provided with at least a second Helmholtz resonator, the first Helmholtz resonator including a first cavity; and a first neck communicating with the first cavity to propagate a sound into the first cavity through the first neck, the second Helmholtz resonator including a second cavity; and a second neck communicating with the second cavity to propagate a sound into the second cavity through the second neck, wherein the first cavity and the second cavity are identical to each other in volume, wherein the first neck and the second neck are identical to each other in cross-sectional area, wherein the first neck and the second neck are different from each other in cross-sectional shape, and wherein the cross-sectional shapes of the first and second necks are an elliptical shape and a perfect circular shape, respectively, and wherein an eccentricity e obtained, for each of the first and second necks, by substituting, into a mathematical expression of $e=\{(MAX^2-MIN^2)^2)^{1/2}\}/MAX$, minimum and maximum values of distances between a center of gravity of a cross section of the neck and individual points defining an outer periphery of the cross section is different between the first and second Helmholtz resonators, where MIN denotes the minimum value and MAX denotes the maximum value.

10. A method for designing a plurality of types of sound absorbing panels each provided with at least one of first and second Helmholtz resonators, said method comprising:

a step of designing a cavity of each of the Helmholtz resonators individually for each of the types of sound absorbing panels, a volume of the cavity being same between the first and second Helmholtz resonators; and a step of designing a neck, communicating with the cavity, of each of the Helmholtz resonators, wherein, whereas a cross-sectional area of the neck is same between the first and second Helmholtz resonators, a cross-sectional shape of the neck is different between the first and second Helmholtz resonators, wherein the cross-sectional shape of the neck of each of the Helmholtz resonators is an elliptical or perfect circular shape, and wherein an eccentricity e obtained by substituting, into a mathematical expression of $e=\{(MAX^2-MIN^2)^2)^{1/2}\}/MAX$, minimum and maximum values of distances between a center of gravity of a cross section of the neck and individual points defining an outer periphery of the cross section is different between each of the Helmholtz resonators, where MIN denotes the minimum value and MAX denotes the maximum value.

11. The method as claimed in claim 10, wherein a length of the neck is same between the first and second Helmholtz resonators.

12. A method for making a plurality of types of sound absorbing panels each provided with at least one of first and second Helmholtz resonators, said method comprising:

a step of forming a cavity of each of the Helmholtz resonators individually for each of the types of sound absorbing panels, a volume of the cavity being same between the first and second Helmholtz resonators; and a step of forming a neck, communicating with the cavity, of each of the Helmholtz resonators, wherein, whereas a cross-sectional area of the neck is same between the first and second Helmholtz resonators, a cross-sectional shape of the neck is different between the first and second Helmholtz resonators, wherein the cross-sectional shape of the neck of each of the Helmholtz resonators is an elliptical or perfect circular shape, and wherein an eccentricity e obtained by substituting, into a mathematical expression of $e=\{(MAX^2-MIN^2)^2)^{1/2}\}/MAX$, minimum and maximum values of distances between a center of gravity of a cross section of the neck and individual points defining an outer periphery of the cross section is different between each of the Helmholtz resonators, where MIN denotes the minimum value and MAX denotes the maximum value.

13. The method as claimed in claim 12, wherein a length of the neck is same between the first and second Helmholtz resonators.

* * * * *